US006180862B1

(12) United States Patent
Hirano

(10) Patent No.: US 6,180,862 B1
(45) Date of Patent: Jan. 30, 2001

(54) SYSTEM AND METHOD FOR EDITING TONE PARAMETER BY USE OF A COMMUNICATION NETWORK

(75) Inventor: Masashi Hirano, Hamamatsu (JP)

(73) Assignee: Yamaha Corporation, Hamamatsu (JP)

( * ) Notice: Under 35 U.S.C. 154(b), the term of this patent shall be extended for 0 days.

(21) Appl. No.: 09/340,600

(22) Filed: Jun. 28, 1999

(30) Foreign Application Priority Data

Jun. 30, 1998 (JP) ..... 10-184898

(51) Int. Cl.[7] ..... G10H 7/00

(52) U.S. Cl. ..... 84/601; 84/645

(58) Field of Search ..... 84/600, 601, 645; 700/94; 434/307 A

(56) References Cited

U.S. PATENT DOCUMENTS 5,563,359 * 10/1996 Okamura ..... 84/600
5,732,219 * 3/1998 Blumer et al. .
5,739,454 * 4/1998 Kunimoto .
5,880,386 * 3/1999 Wachi et al. ..... 84/601
5,953,005 * 9/1999 Liu ..... 434/307 A X

FOREIGN PATENT DOCUMENTS 62-049635 * 10/1987 (JP) .

* cited by examiner

*Primary Examiner*—Jeffrey Donels
(74) *Attorney, Agent, or Firm*—Morrison & Foerster

(57) ABSTRACT

A method is disclosed which edits a tonal-characteristic defining parameter by use of at least two computers, such as client and server computers, interconnected via a communication network. The client computer itself need not be equipped with an editor, i.e., an editing program, and it can utilize a desired editor or editing program on an on-line basis via the communication network. That is, desired editing data is input to the client computer, so that the editor or editing program of the server machine is run on-line in response to the editing data input and a result of editing by the editing program is sent back to the client computer via the communication network. For example, when a desired editor is selected via the client computer, an editing screen is supplied from the server computer to the client computer, so that the client computer carries out a desired editing input operation with reference to the supplied editing screen and then the server machine executes editing processing using the selected editor and in response to the editing input and transmits a result of the editing processing to the client computer. The edited result can be used by the client computer in tone generation or other tone- or music-related processing etc. In case the server is not equipped with the selected editor, the server conducts a relay such that the editing processing is executed via another computer on the network equipped with the selected editor.

35 Claims, 12 Drawing Sheets

PARAMETER EDIT : PIANO_1

| No. | Category | PARAMETER | DATA |
|---|---|---|---|
| 1 | ID | VOICE NAME | PIANO_1 |
| 2 | Wave | Wave Name | Multi_Sampled_PIANO |
| 3 | | Initial Phase | 0 |
| 4 | Filter | Filter_type | LPF |
| 5 | | Cutoff | 5kHz |
| 6 | | Q | 041 |
| 7 | Amplitude | AEG_attack | 127 |
| 8 | | AEG_decay1 | 065 |
| 9 | | AEG_decaylevel | 056 |
| 10 | | AEG_decay2 | 034 |
| 11 | | AEG_sus-level | 0 |
| 12 | | AEG_release | 015 |
| 13 | Effect | Reverb Level | 089 |

20 : TUBULAR-BODY SIMULATING SECTION $$K_i = \frac{\phi_{i1}^2 - \phi_i^2}{\phi_{i-1}^2 + \phi_i^2}$$

$$\alpha_i = \frac{2\phi_{i-1}^2}{\phi_{i-1}^2 + \phi_i^2}$$

$$\beta_i = \frac{2\phi_i^2}{\phi_{i-1}^2 + \phi_i^2}$$

$$\alpha_i = \frac{2\phi_{i-1}^2}{\phi_{i-1}^2 + \phi_i^2 + \varphi_i^2}$$

$$\beta_i = \frac{2\phi_i^2}{\phi_{i-1}^2 + \phi_i^2 + \varphi_i^2}$$

$$\gamma_i = \frac{2\varphi_i^2}{\phi_{i-1}^2 + \phi_i^2 + \varphi_i^2}$$

SYSTEM AND METHOD FOR EDITING TONE PARAMETER BY USE OF A COMMUNICATION NETWORK

BACKGROUND OF THE INVENTION

The present invention relates to a tone parameter editing method and system which use a communication network to edit parameters that define characteristics of tones to be generated, and also relates to a tone generating method and system which generate a tone by use of the edited parameters.

Parameter editing apparatus or systems for use in electronic musical instruments have been known which are designed to permit creation of a variety of sounds by varying parameters that define characteristics of tones to be generated. Among various types of such parameter editing apparatus or systems are one where a list of all editable tone parameters is visually shown on a display to allow the thus-displayed parameters to be modified in value as desired for editing purposes, and one where the tone parameters are edited while envelope waveforms of the tone parameters set to particular values are also graphically displayed to show a corresponding relation between the set values and the envelope waveforms specified thereby.

However, because items of the tone parameters to be set tend to greatly differ depending on properties and types of tone colors and tonal effects to be imparted, the conventionally-known editing apparatus would require a complicated construction if all the tone parameters for a great number of tone colors are to be edited solely by the single editing system. Where, on the other hand, the editing system is designed to edit only some, such as the "greatest common divisors", of the items of the tone parameters, tone parameter items that can not be set at all would unavoidably arise with certain of the tone colors, which would lead to dissatisfaction of a user. A plurality of the editing apparatus may be provided in order to cover all of the tone parameters likely to be edited; however, this approach would impose great economic and other burdens on the user. The same inconveniences would be encountered in cases where the tone parameters are edited by software using an editor or editing program.

Further, in recent years, it has become possible to create musical tone colors not existing in reality, by virtue of emergence of physical model tone sources or generators that are designed to simulate the tone generation principles of natural musical instruments by use of electric models; a typical example of such physical model tone generators is disclosed in Japanese Patent Laid-open Publication No. HEI-5-80761. Consequently, the tone parameters are getting more and more diverse and complex, which would present an increasing difficulty in editing the tone parameters for a great number of tone colors.

Japanese patent publication No. 62-49635 discloses a parameter information setting device for use in an electronic musical instrument, wherein the parameter information setting device is separated from the electronic musical instrument, connected to the instrument via a wiring cable, and provided with an input device for editing tone parameters and a tone parameter editing mechanism or program as well. While the tone parameters edited by the parameter information setting device are supplied to the electonic musical instrument via the wiring cable, an input for editing and editing processing responsive to the input are exclusively performed by the parameter information setting device by means of the input device and the tone parameter editing mechanism or program thereof, and the electronic musical instrument only receives the supplied tone parameters. Thus, it is also necessary for the parameter information setting device as shown in the Japanese patent publication to be provided with a plurality of the editing mechanisms or programs in order to cover all of the tone parameters likely to be edited.

SUMMARY OF THE INVENTION

It is therefore an object of the present invention to provide a tone parameter editing method and system which can edit tone parameters for a number of tone colors and/or other characteristics of tones without providing a plurality of editing devices, mechanisms or programs.

In order to accomplish the above-mentioned object, the present invention provides a method of editing a parameter defining a characteristic of a tone by use of at least two computers interconnected via a communication network, which comprises: a first step of accepting a parameter editing input by means of a first one of the computers; a second step of transmitting data, corresponding to the parameter editing input accepted by the first computer, to a second one of the computers via the communication network; a third step of using at least the second computer to execute parameter editing processing responsive to the data transmitted to the second computer and then sending a result of the executed parameter editing processing back to the first computer via the communication network; and a fourth step of receiving, by means of the first computer, the result of the parameter editing processing sent back by the third step.

In a typical application, the first computer is a client computer while the second computer is a server computer. In this invention, the client computer itself need not be equipped with an editor, i.e., an editing program; instead, it can utilize an editor or editing program, provided remotely from the client computer, on an on-line basis via the communication network. In this case, desired editing data is just input to the client computer, so that the editor or editing program of the server machine is run on-line in response to the editing data input and a result of the editing (edited result) is sent back to the client computer via the communication network. In this way, the edited result can be used by the client computer in tone generation or other tone- or music-related processing purposes etc. Thus, it is no longer necessary for the client computer to be equipped with a plurality of editing devices or editing programs in order to serve a variety of tone parameter editing as desired by the user, and it is possible to significantly reduce the load on the client computer and hence the user of the client computer.

As one example, the third step may cause a third one of the computers on the communication network to carry out the parameter editing processing, responsive to the transmitted data, using the communication network and through a data relay by the second computer. In this way, even where the second computer is unable to execute the parameter editing processing as requested by the first computer, the second computer can conduct the relay such that the requested parameter editing processing is executed by the third computer capable of that editing processing. Therefore, by only designating and communicating with a particular computer (the second or server computer), the client computer can make use of any desired editing programs (even an editing program not owned by the designated computer), which can be very convenient to the user.

In the context of the present invention, the "computers" may be devices or equipment containing a processor or central processing unit (CPU), i.e., devices or equipment having a processor or computer function, rather than general-purpose or independent computers such as personal computers. Namely, the terms "computers" as used in connection with the present invention should be construed as encompassing even some form of special-purpose devices, such as keyboard-based instruments, automatic performance sequencer modules, tone generator modules, keyboard modules, automatic rhythm modules or editor modules, as long as they contain a processor or computer.

Further, the present invention may be implemented as a system or apparatus invention as well as a method invention. What is more, the present invention may be implemented as a program for use with a computer or a processor such as a DSP, or as a recording medium storing such a program.

BRIEF DESCRIPTION OF THE DRAWING

For better understanding of the object and other features of the present invention, its preferred embodiments will be described in greater detail hereinbelow with reference to the accompanying drawings, in which.

DETAILED DESCRIPTION OF THE PREFERRED EMBODIMENTS

1. Overall System Organization

Tone parameter editing system in accordance with a preferred embodiment of the present invention is applied to a computer system using a communication network. Once a user enters, into a client machine, data for setting one or more tone parameters, the client machine transmits the entered data to a server machine, and then the server machine or the like generates the tone parameters on the basis of the data transmitted from the client machine to thereby send the generated tone parameters back to the client machine. Thus, the client machine receives and sets the tone parameters inside the machine.

Figure 1:
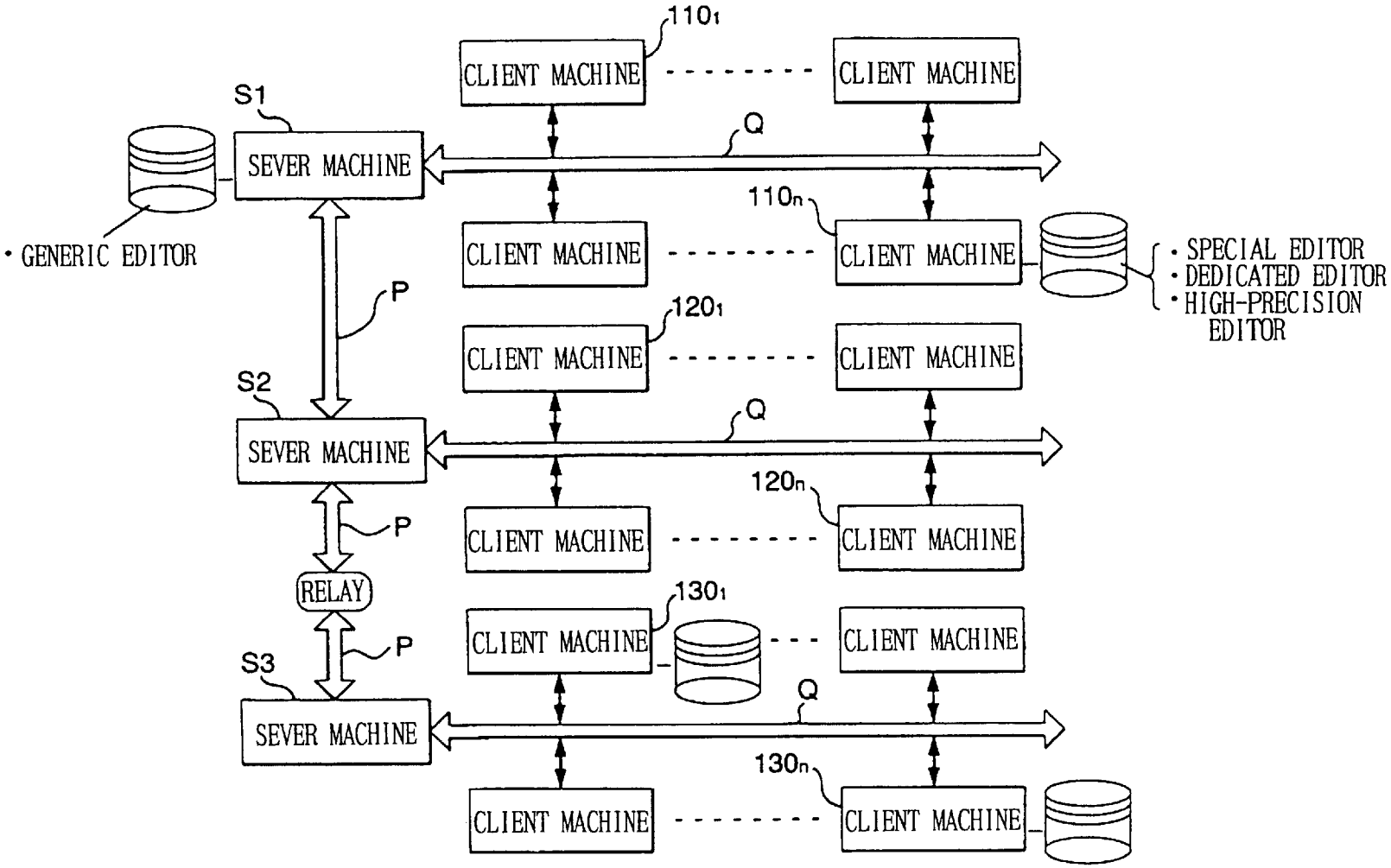
FIG. 1 is a block diagram illustrating an overall organization of a tone parameter editing system in accordance with a preferred embodiment of the present invention.

FIG. 1 is a block diagram illustrating an overall organization of a communication network to which is applied the tone parameter editing system of the present invention. In the communication network as shown, server machines Si, S2 and S3 are connected with one another via respective main lines P, to each of which is connected a multiplicity of client machines $\mathbf{110}_1$, . . . , $\mathbf{120}_1$, . . . or $\mathbf{130}_1$, . . . , via a secondary line Q. This way, communication is permitted between the sever machines, between the server and client machines and between the client machines.

Although the server machines S2 and S3 in the illustrated example are interconnected via the internet, illustration of various components necessary for connection to the internet, such as routers and terminal adaptors, is omitted here because they are not directly pertinent to the present invention. Further, the communication network of FIG. 1 is just illustrative; that is, the present invention should not be construed as limited only to the illustrated communication network. The communication network need not be a worldwide network based on the internet and may be just a LAN (Local Area Network) within a company or corporate organization. Further, whereas the communication network will hereinafter be described in connection with a case where the server machines and client machines are clearly separated from each other, the present invention may also be applied to a so-called "peer-to-peer" communication network where the server machines and client machines are not clearly separated from each other. It is only essential that the communication network include at least two terminal machines.

1-1. Construction of Client Machine:

The construction of each of the client machines will be described below with reference to FIG. 2. Note that the terms "client machine" is used herein to refer to a computer operated directly by a user.

Figure 2:
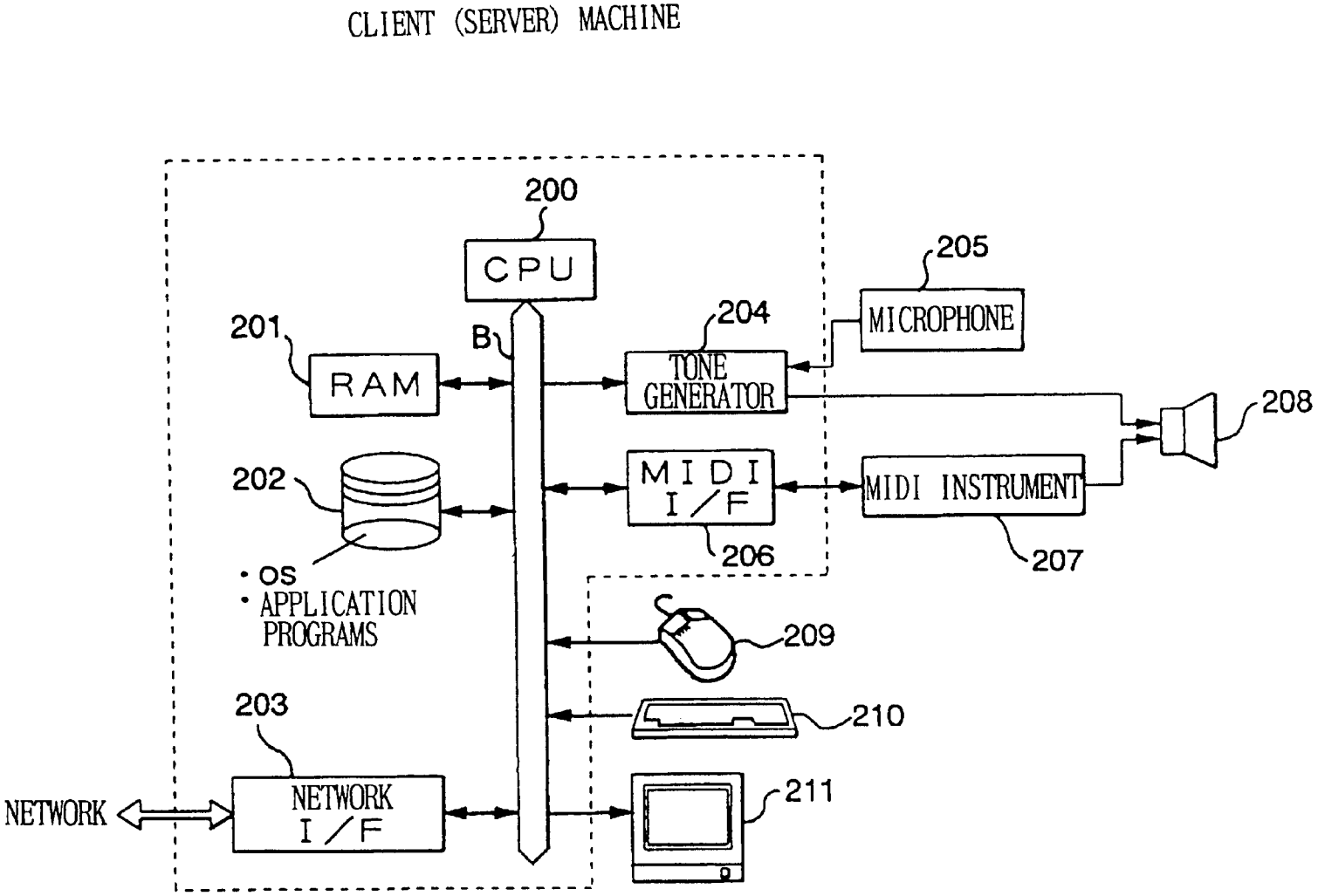
FIG. 2 is a block diagram illustrating a detailed construction of each client machine or server machine employed in the embodiment of FIG. 1.

In FIG. 2, the client machine includes a CPU 200 which controls various components within the client machine via a bus B in accordance with an OS (Operating System), as will be later described in detail. The OS in the instant embodiment operates in a multi-window fashion using the so-called GUI (Graphical User Interface). RAM 210 is provided for temporarily storing various data resulting from various control operations of the CPU 200, as well as tone color data and the like to be described later. Storage unit 202 stores the above-mentioned OS and application programs to be described later. Network interface (I/F) 203 is in the form of, for example, an Ethernet board and provides a connection between the communication network and the bus B.

Further, in the client machine, a tone generator (T.G.) circuit 204 contains a D/A converter circuit which converts a tone signal into an analog representation under the control of the CPU 200, and is provided in a circuit board similarly to the above-mentioned network interface 203. This tone generator circuit 204 also contains an A/D converter which converts an analog signal from a microphone 205, connected to the client machine as necessary, into a digital representation for various control or data entry purposes.

MIDI interface 206 is provided for connection between a MIDI instrument 207 for generating a tone signal in accordance with MIDI data and the body of the client machine. Sound system 208 includes one or more amplifiers and speakers for audibly reproducing (i.e., actually sounding) the tone signal.

To the client machine are connected various other components, such as a mouse 209 and a keyboard 210 for the user to enter various desired data and instructions and a display 211 for visually showing various information. It will be appreciated that each of the client machines employed in the present invention may be a general-purpose computer such as a personal computer, but also a dedicated or special-purpose electronic musical instrument containing a processor and provided with a communication device.

Examples of the application programs employed in the instant embodiment include first application programs for carrying out musical performance and tone generation by use of the tone generator circuit 204 and MIDI instrument 207, second application programs (i.e., editors or editing programs) for entering, modifying and editing information defining tone parameters to thereby create tone parameters, and third application programs (i.e., browsers) for controlling viewing, link and transmission/reception of text and image information. Note that the terms "parameter editing" are used herein in its broad sense and thus should be construed as directed not only to setting, modification, deletion, insertion of a tone parameter but also to mere selection of a tone parameter.

Of these three major types of application programs, the editors are not necessarily essential to the present invention because they are to be prepared depending on the properties and varieties of tone colors used similarly to those as discussed earlier in relation to the prior art. The browsers only have functions of selecting a desired editor and entering, modifying and editing information defining tone parameters; the browsers employed in the instant embodiment have no function of directly generating the tone parameters; in this respect, the browsers are different from the editors.

As clearly seen from the construction of FIG. 2, each of the client machines has a function of generating a tone in some suitable manner; in this sense, the client machine need not have both the tone generator circuit 204 and the MIDI instrument 207 and may be provided with only one of them.

Each of the server machines is similar in construction to the above-described client machines except in that it need not have a tone generating function, and also that it stores all of programs for creating tone parameters from the parameter-defining information (i.e., editors) that are likely to selected by the respective users of the individual client machines. Here, the terms "server machine" are used to refer to a computer which is not operated directly by the users.

It will also be appreciated that the editors or editing programs are stored distributively in a storage unit of the server machine concerned and in the storage units of some of the client machines subordinate to the server machine whose operation the users are not directly involved in. Specifically, in the illustrated example of FIG. 1, the server machine S1 is equipped with a generic editor that is to be used only for editing of basic tone colors, while the client machines $\mathbf{110}_n$ subordinate to the server machine S1 is equipped with special editors for use in editing of special tone colors (such as those generated by a physical model tone generator as will be later described), dedicated editors for editing peculiar tone colors in a special manner, and high-precision editors for editing the tone colors with a high precision. FIG. 1 also shows how the server and client machines correspond to these editors.

Figure 3:
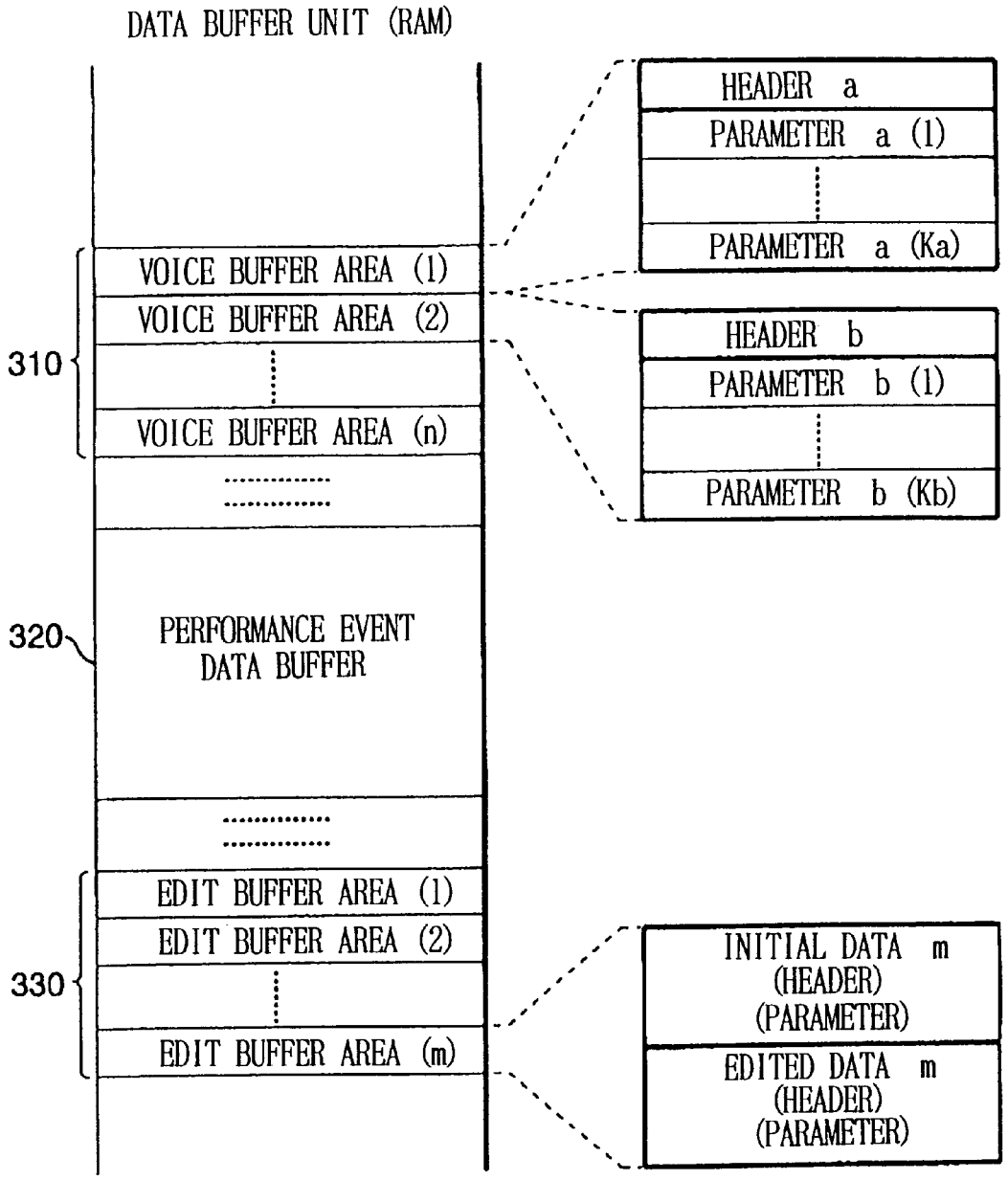
FIG. 3 is a diagram illustrating a memory map of a RAM provided in the client machine.

1-1-1. Memory Map of Tone Color Data:

The following paragraphs describe a data buffer unit provided, within the RAM 201 of each of the client machines directly operated by the users, for storing tone color data and such. As shown in a memory map of FIG. 3, the data buffer unit includes three major buffers, a used-tone-color-data buffer 310, a performance-event-data buffer 320 and a tone-color-edit-data buffer 330.

In the used-tone-color-data buffer 310, tone color data, corresponding to a specific number of tone colors to be used in music performance, are set in respective voice (tone color) buffer areas (1)–(n). Each of the voice buffer areas is made up of a region for storing a header and regions for storing data relating to various tone parameters. In the illustrated example, the header includes a name of the tone color and administrative or managerial information designating a tone generator, tone generating channel and MIDI channel to be used for generation of the tone color. In the case of tone color editing, the terms "tone parameter" refer to data defining characteristics of the tone color in question, and normally a plurality of such data are subjected to editing processing by the present invention. Of course, the terms "tone parameters" as used in connection with the present invention encompass all parameters relating to a tone in some way or another, rather than being limited only to the data defining the tone color characteristics.

In the performance-event-data buffer 320, there are set event data that indicate a time series of tone generating events, tone deadening events, etc. occurring in the course of a music performance, and duration data each indicative of a time interval between the successive events, although not specifically illustrated here for simplicity. During the music performance, these data are read out sequentially from the performance-event-data buffer 320.

Further, in the tone-color-edit-data buffer 330, only those of the tone color data in the voice buffer areas (1)–(n) which are designated as a subject for editing are copied into any one of edit buffer areas (1)–(m). Each of the edit buffer areas (1)–(m) is composed of a region for storing original or initial tone color data (i.e., tone color data before editing) and a region for storing edited tone color data (i.e., tone color data having been edited, in accordance with user's editing input operation, to assume a new or modified value. Each of the initial and edited tone color data has a header and tone parameters. Thus, immediately after a tone color to be edited is selected and before the actual editing is carried out on the selected tone color, the tone color data designated as a subject for editing has been set in both the initial data storage region and the edited data storage region. After the data is edited and returned to one of the voice buffers from which it was copied, a tone is generated with the edited tone color. If the edited data is saved after the editing, it can be registered for subsequent use as a new tone color.

Although other data than the above-mentioned tone color and performance event data are also set in the RAM 201, these data do not directly relate to the present invention and hence will not be described in detail here.

2. Operational Flows

Now, a description will be made as to operational flows of the tone parameter editing system according to the present invention. Here, the behavior of the client machine and server machine will be detailed separately for convenience of description.

2-1. Behavior of Client Machine:

First, the behavior of the client machine directly operated by the user will be described with reference to FIG. 4.

Upon power-on of the client machine, the CPU 200 of the activated client machine carries out a predetermined initialization process at step Sal as dictated by the operating system (OS), which includes a checkup on the RAM 201 and allocation of the necessary data buffer areas in the RAM 210.

Then, at step Sa2, the CPU 200 detects a task activation event. Specifically, the CPU 200 detects a state change (i.e., event) having occurred by the user operating the mouse 209 and/or the keyboard 210; for example, the state change is brought about by the user double-clicking on an icon graphically representing a task or giving various instructions using predetermined keys on the keyboard. Types of these instructions are generally set as dictated by the OS.

At next step Sa3, the CPU 200 carries out an application task management process to make a different branch in accordance an event detected. Note that details or contents of the management at step Sa3 differ depending on the environmental conditions of the client machine and the contents of the management shown in FIG. 4 are Just for illustrative purposes.

Namely, if the event detected at step Sa2 is an instruction relating to tone generator (T.G.) processing, the CPU 200 goes to step Sa4, where the tone generator processing or tone generator control processing is carried out in accordance with any of the aforesaid first application programs. Here, in the tone generator processing, a tone color defined by currently-set tone parameters is tentatively sounded by means of the tone generator circuit 204 and MIDI instrument 207. The tone generator control processing is directed, for example, to setting or changing states of the tone generator circuit 204 or MIDI instrument 207. Such tone generator processing or tone generator control processing is already known in the art and has no direct relation to the present invention, and hence a further description thereof will be omitted. Upon completion of the tone generator processing or tone generator control processing, the CPU 200 reverts to step Sa2 to wait for a further instruction.

If the event detected at step Sa2 is an instruction relating to tone color editing processing (hereinafter also called "voice editor processing"), the CPU 200 goes to step Sa5, where the voice editor processing is carried out in accordance with any of the aforementioned second programs on an off-line basis as will be later described in detail.

If the event detected at step Sa2 is an instruction relating to performance information processing, the CPU 200 goes to step Sa6, where the performance information processing is carried out by means of the tone generator circuit 204 and MIDI instrument 207 in accordance with any of the aforesaid first application programs. Here, the performance information processing is directed, for example, to using the tone generator circuit 204 and MIDI instrument 207 to load music piece data and actually carrying out a music performance in accordance with the loaded music piece data. Because this performance information processing is also already known in the art and has no directly relation to the present invention, a further description thereof will be omitted. Upon completion of the performance information processing, the CPU 200 reverts to step Sa2 to wait for a further instruction.

Furthermore, if the event detected at step Sa2 is an instruction relating to browser processing, the CPU 200 goes to step Sa7, where the browser processing is carried out in accordance with any of the aforesaid third application program as will be later described in detail.

Furthermore, if the event detected at step Sa2 is an instruction relating to other processing than the above-mentioned, the CPU 200 carries out the other processing and then reverts to step Sa2 to wait for a further instruction. In case, however, the detected event is an end instruction, the CPU 200 carries out predetermined end processing and terminates the operational flow without reverting to step Sa2.

Figure 5:
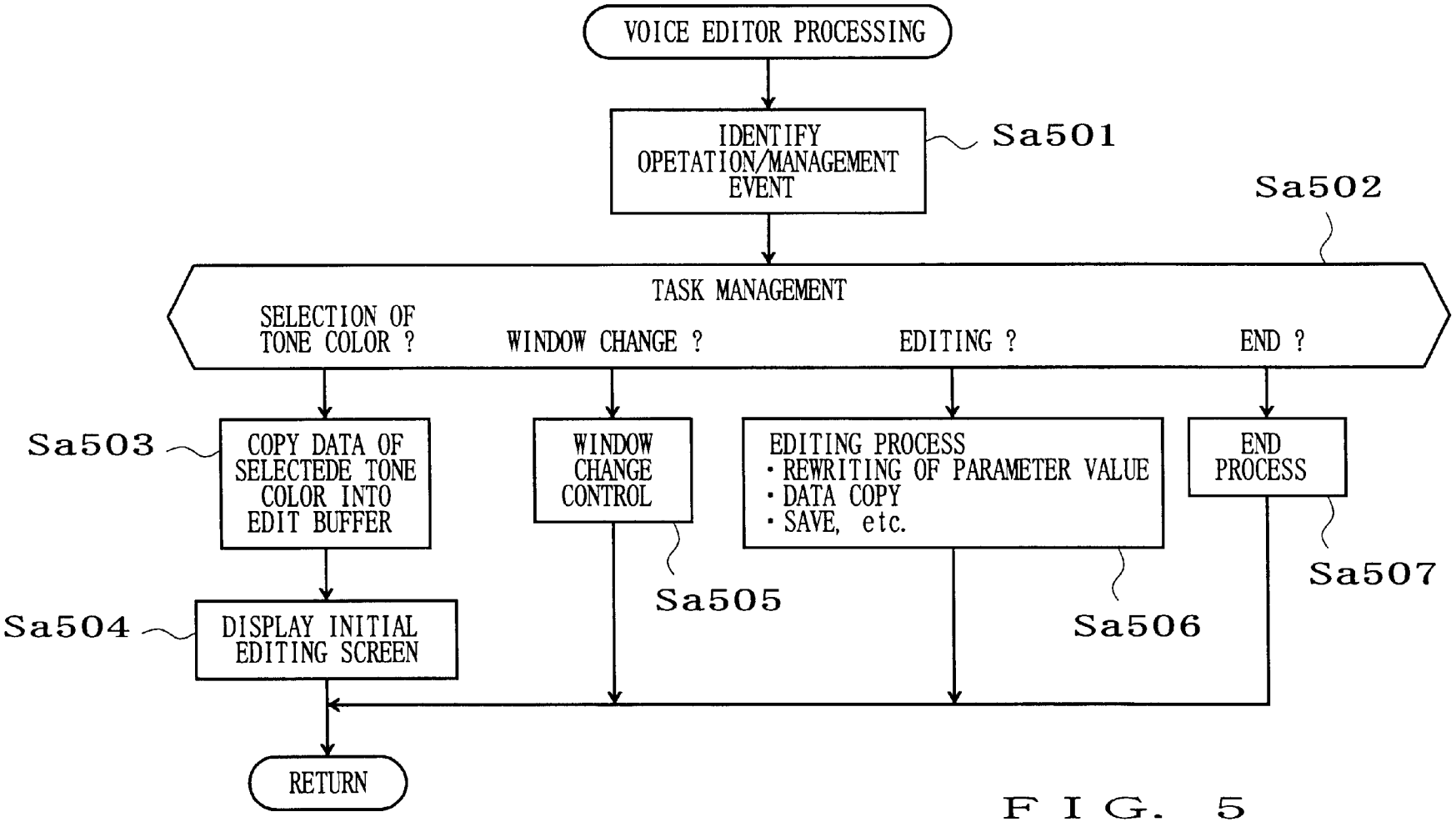
FIG. 5 is a flow chart illustrating voice editor processing carried out in the client machine.

2-1-1. Voice Editor Processing:

The following paragraphs describe details of the voice editor processing carried out at step Sa5, with reference to a flow chart of FIG. 5. Although this program itself is not essential to the present invention as noted above, it is described here for the purpose of comparison with the prior art. At first step Sa501, the CPU 200 identifies an event such as a user's operation and a task management state. At next step Sa502, the CPU 200 makes a different branch in accordance with an identified result.

Specifically, if the event identified at step Sa502, the CPU 200 goes to step Sa503 where each tone color data designated as a subject for editing is copied from the voice buffer area of the used-tone-color-data buffer 310 into the initial data storage region and edited data storage region of the edit buffer area 330. After that, the CPU 200 proceeds to step Sa504, where an initial editing (window) screen is created for editing the tone color data in question and this screen is visually shown on the display 211 of the machine. Thus, this voice editor processing opens as many windows as the number of the tone color data to be edited.

If the event identified at step Sa502 is an event instructing a window change, the CPU 200 goes to step Sa505, where only the window corresponding to the designated tone color data is activated and the other windows are made inactive.

Further, if the event identified at step Sa502 is an instruction event relating to an editing process, then the CPU 200 goes to step Sa506 in order to carry out the editing process corresponding to the instruction event. More specifically, in case the instruction is directed to a change in a tone parameter value, the value of the edit data in question is rewritten into a new value. In case the instruction is directed to a transfer of a tone parameter value, the data of a destination (transferred-to) region is replaced by the data of a source (transferred-from) region. In case the instruction is directed to a registration of a tone parameter value, the tone parameter value is stored into the storage unit 202 of the machine. In this way, various editing operations are actually carried out at step Sa506.

Furthermore, if the event identified at step Sa502 is an instruction event to terminate the voice editor processing, the CPU 200 goes to step Sa507 in order to close all the windows and end the voice editor processing as instructed.

Figure 4:
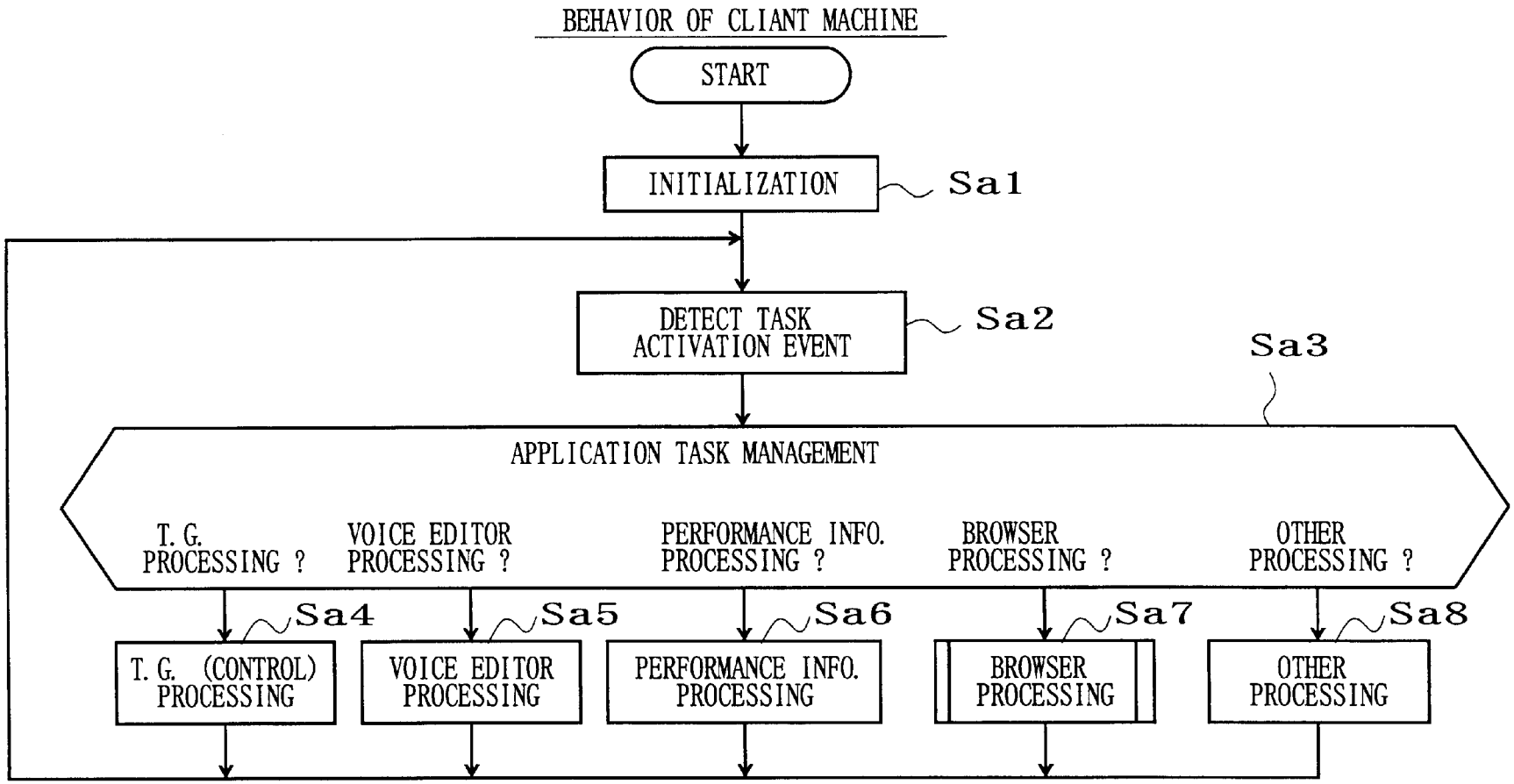
FIG. 4 is a flow chart illustrating exemplary behavior of the client machine in the embodiment.

After completion of any one of the above-described operations of step Sa504 to Sa507, the CPU 200 reverts to step Sa2 of FIG. 4 to wait for a further instruction.

The above-described voice editor processing allows editing of the tone color data, including tone parameters, to be carried out off-line solely by the single client machine without using the communication network, and thus this voice editor processing appears to be useful. In effect, however, the voice editor processing is useful only in the case where the tone color designated as a subject for editing corresponds to or is supported by the voice editor installed in the client machine; no editing is permitted if the designated tone color is not supported by the installed voice editor. Further, providing a voice editor capable of supporting every tone color that is likely to be designated as a subject for editing would not only impose a heavy burden on the user but also use a considerable proportion of the limited capacity of the storage unit 202 of the machine.

2-1-2. Browser Processing:

With reference to a flow chart of FIG. 6, a description will now be made as to exemplary details of the browser processing that is a significant feature in the instant embodiment. At first step Sa701, the CPU 200 identifies an event such as a user's operation and task management state. At next step Sa702, the CPU 200 makes a different branch in accordance with the identified result.

2-1-2-1. Activation:

Specifically, if the event identified at step Sa701 is an operation event to start or activate the browser processing, the CPU 200 goes to step Sa703 in order to display an initial browser screen and then reverts to step Sa2 of FIG. 4 to wait for a further instruction.

2-1-2-2. Editor Selection:

If the event identified at step Sa701 is an operation event to select an editor, the CPU 200 goes to step Sa704 to carry out an editor link process. The browser processing is arranged to provide a link to a plurality of editors to edit tone parameters corresponding to a great number of tone colors. Thus, when the user wants a tone parameter to be edited, the user selects one of the editors in accordance with a particular tone color to be edited. Once such an editor selection is made by the user, the CPU 200 sends data indicative of the selected editor EDITy, a request for transmission of editing screen data of the selected editor, etc. to one of the server machine S1 equipped with the generic editor on the communication network. The data transmission to the server machine S1 may be done such as by designating an IP (Internet Protocol) address corresponding to the server machine S1. Further, it is preferable that the editing screen data be in the HTML (Hyper Text Markup Language) format.

After completion of the editor link process, the CPU 200 proceeds to step Sa705 in order to shift the operating mode to a later-described reception mode and then reverts to step Sa2 of FIG. 4 to get ready for sending back of data from the server machine S1.

2-1-2-3. Editing Mode:

If the event identified at step Sa701 is a managerial event indicating a shift to an editing mode, the CPU 200 goes to step Sa706 to carry out a process corresponding to a user's editing input operation on an editing screen. Here, the editing screen is created on the basis of the data received from the server machine S1 in the later-described reception mode, and it corresponds to the user-selected editor. Let's also assume here that at least a tone color has been designated, by the user, as a subject for editing through his or her editing input operation. Therefore, by this time, the tone color data corresponding to the user-designated tone color has been transferred from the voice buffer area of the used-tone-color-data buffer 310 to the initial data storage region and edited data storage region of the edit buffer area 330 for storage therein.

Figure 10:
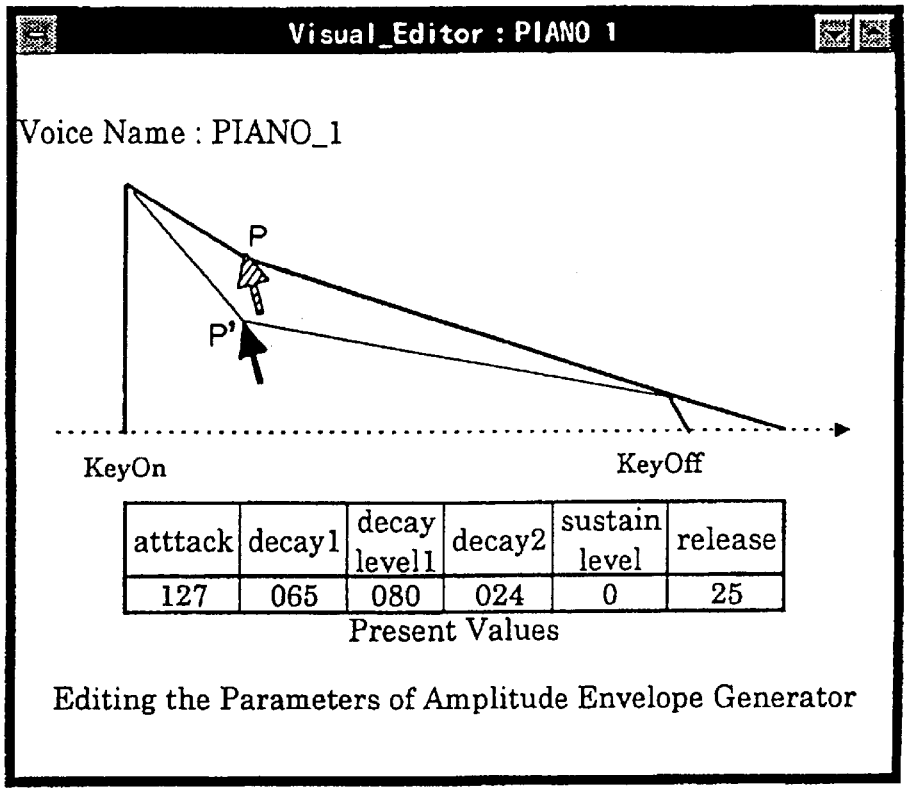
FIG. 10 s a diagram showing an example of an editing screen displayed in off-line voice editor processing in a similar manner to the conventionally-known parameter editing apparatuses.

The editing input operation at step Sa706 may be carried out in various ways. For example, when the tone color designated as a subject for editing is a "piano" tone color and a tone parameter relating to the amplitude envelope of the piano tone color is to be edited, the user may manipulate the mouse 209 in such a manner that the time-varying shape of the amplitude waveform is changed as desired by moving its pointer P to other location P' as shown in FIG. 10. The editing screen of FIG. 10 is also created on the basis of the data sent back from the server machine S1 in response to the selected editor.

Then, at step Sa707, the CPU 200 makes a determination as to whether the user's editing input operation has been completed or not. With a negative (NO) determination at step Sa707, the CPU 200 reverts to step Sa2 of FIG. 4 to wait until the user's editing input operation is completed. If answered in the affirmative (YES), however, the CPU 200 proceeds to step Sa708, in order to transmit to the server machine S1 data DATASET indicative of the editing input result. Here, to explain in relation to the editing screen of FIG. 10, the terms "editing input result" refer to individual coordinates points defining the time-varying shape of the amplitude envelope having been changed as a result of the user's editing input operation. Namely, the data DATASET indicative of the editing input result are data indirectly defining the tone parameter and having been entered via the user's editing operation, rather than the tone parameter value itself. For this reason, the CPU 200 also obtains the data DATASET indicative of the editing input result at step Sa706.

After that, the CPU 200 shifts the operating mode to the later-described reception mode at step Sa709 and reverts to step Sa2 of FIG. 4 to get ready for sending back of the data from the server machine S1.

2-1-2-4. Reception Mode:

Further, if the event identified at step Sa701 is a managerial event indicating a shift to the reception mode, the CPU 200 goes to step Sa7lO, where the CPU 200 receives and identifies the data sent back from the server machine S1 and then actually shows a screen on the display 211 on the basis of the identified data. After that, the CPU 200 proceeds to step Sa711 in order to determine whether or not all the relevant data have been received from the server machine S1. If answered in the negative (NO), the CPU 200 reverts to step Sa2 of FIG. 4 in order to complete the data reception from the server machine S1. With an affirmative answer at step Sa711, however, the CPU 200 makes a further determination at step Sa712 as to whether the received data are tone parameter data PARSET that are indicative of a tone parameter itself and, in other words, a result of arithmetic operations carried out on the basis of the above-mentioned data DATASET.

If answered in the negative at step Sa711, this means that all the relevant data have been received from the server machine S1, the received data are, for example, editing screen data and also the CPU 200 is in a state waiting for a user's editing input, so that the CPU 200 goes to step Sa713, where the reception mode is cancelled and the operating mode is shifted to the editing mode.

If an affirmative (YES) determination is made at step S712, this means that all the data have been received from the server machine S1 and the received data are the tone parameter data PARSET having been created by the server machine S1 or the like, so that the CPU 200 moves on to step Sa714. At this step Sa714, the CPU 200 transfers the tone parameter data PARSET to the edit buffer 330 for copied storage in the corresponding edited data storage region, and visually shows on the display 211 the tone parameter and time-varying shape conforming to the parameter.

The affirmative or YES determination at step Sa712 is based on the premise that at least a tone color has been designated, by the user, as a subject for editing, the designated editing has been completed for the user-designated tone color and the edited result has been transmitted to the server machine S1. Thus, by this time, the tone color data corresponding to the user-designated tone color has been transferred from the voice buffer area to the initial data storage region and edited data storage region of the edit buffer area 330. Therefore, the "corresponding edited data storage region", as referred to in connection with step Sa714, is one associated with the voice buffer area originally storing the designated tone color data.

After that, the CPU 200 cancels the reception mode at step Sa715 and then reverts to step Sa2 of FIG. 4 to wait for a further operational instruction and the like.

2-1-2-5. End Mode:

Finally, if the event identified at step Sa701 is an instruction to terminate the browser processing, the CPU 200 carries out an end process at step Sa716 that includes an operation to close all the windows having so far been opened for this browser processing, and then reverts to step Sa2 of FIG. 4 for detection of any new task activation.

2-2. Behavior of Server Machine:

Next, the behavior of the server machine not directly operated by the user will be described with reference to a flowchart of FIG. 7. Upon power-on of the server machine, the CPU 200 of the activated server machine carries out a predetermined initialization process at step Sb1 in accordance with the OS, and then detects a task-related event such as a reception state or operating state at step Sb2. At next step Sb3, the CPU 200 makes a different branch in accordance with the detected event. More specifically, if the event detected at step Sb2 is one relating to on-line editor processing, the CPU 200 goes to step Sb4 in order to carry out the on-line editor processing. If, however, the event detected at step Sb2 is one relating to other processing, such as an instruction to turn of f the power to the server machine, the CPU 200 goes to step Sb5 in order to carry the other processing such as turning off of the power. After step Sb4 or Sb5, the CPU 200 reverts to step Sb2 for detection of a further task-related event.

Figure 8:
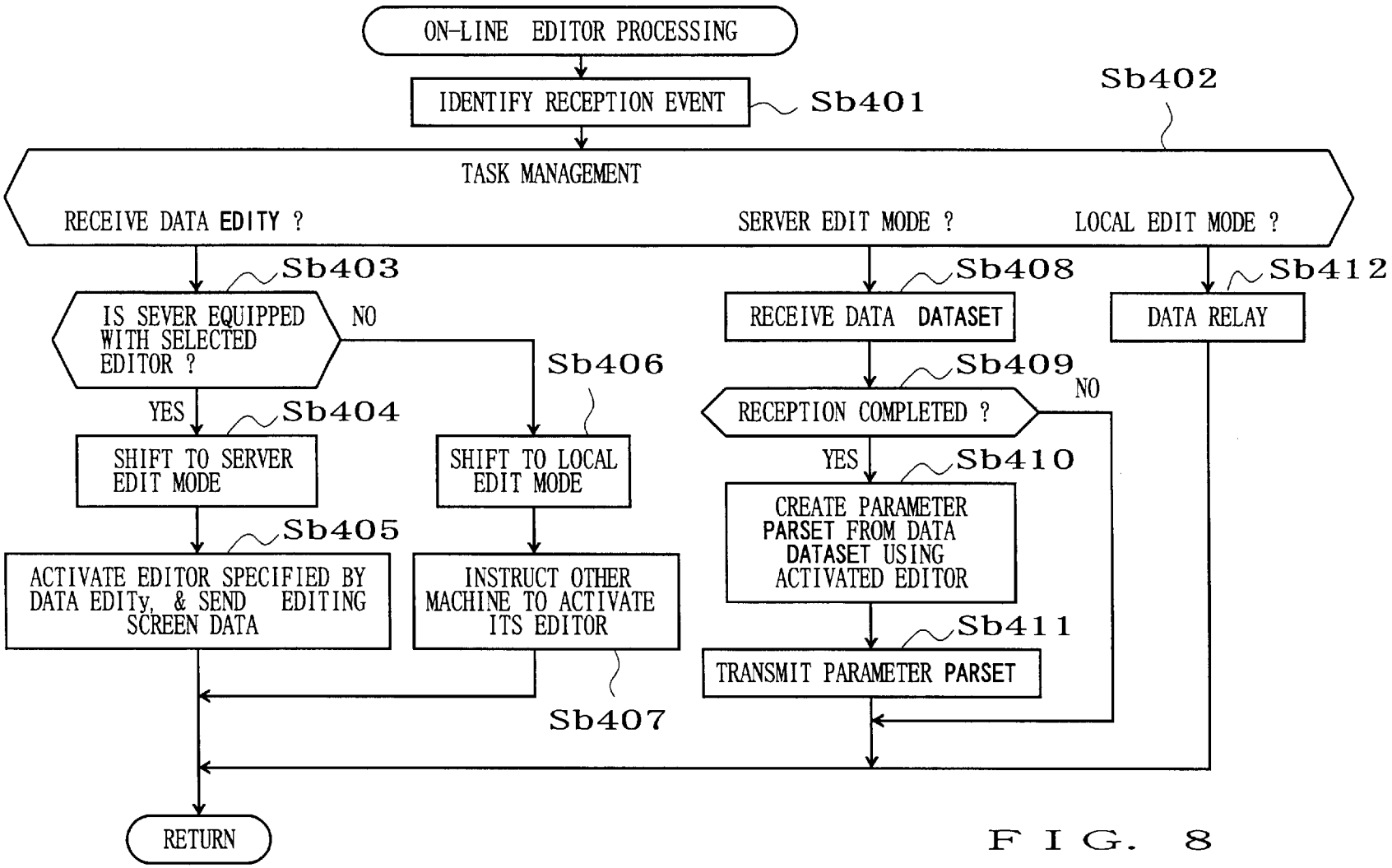
FIG. 8 is a flow chart illustrating one-line editor processing carried out in the server machine.

2-2-1. On-line Editor Processing:

The following paragraphs describe exemplary details of the on-line editing processing carried out at step Sb4, with reference to a flow chart of FIG. 8. At first step Sb401 in the on-line editing processing, the CPU 200 of the server machine identifies an event relating to this on-line editing processing. At next step Sb402, the CPU 200 carries out task management corresponding to the identified event as will be described below.

2-2-1-1. Check on Received Data EDITy:

If the event identified at step Sb401 is an event indicative of reception of the editor-specifying data EDITy sent from the client machine at the above-described step Sa704 (FIG. 6), the CPU 200 makes a determination at step Sb403 as to whether or not the server machine in which the CPU 200 is included (hereinafter "associated server machine") is equipped with the editor indicated by the data EDITy. Namely, the client machine selects an editor corresponding to the tone color designated as a subject for editing and sends to a designated one of the server machines the data EDITy indicating the selected editor, and then the CPU 200 of the designated server machine determines whether or not that server machine is capable of generating tone parameter data PARSET on the basis of the input data DATASET using the selected editor.

Because the server machine S1 is only equipped with the generic editor as mentioned above, an affirmative (YES) determination is made at Sb403 when the editor specified by the data EDITy is the generic editor and the data EDITy has been duly received by the server machine S1. When the editor specified by the data EDITy is the special editor and the editor-specifying data EDITy has been duly received by the server machine S1, a negative (NO) determination is made at Sb403, because the server machine is not equipped and hence unable to execute the specified editor.

With the affirmative determination at step Sb403, the CPU 200 of the server machine, at step Sb404, shifts the operating mode to a server edit mode in which subsequent operations are carried out by the associated server machine. At following step Sb405, the CPU 200 activates the editor program specified by the received data EDITy and also sends editing screen data, corresponding to the editor, back to the client machine from which the editor-specifying data EDITy were originally sent.

With the negative determination at step Sb403, on the other hand, the CPU 200 of the server machine, at step Sb406, shifts the operating mode to a local edit mode in which subsequent operations are carried out by another machine on the communication network. At following step Sb407, the CPU 200 first searches through the communication network for a particular machine equipped with the editor specified by the data EDITy or identifies such a machine from among those previously registered therein, and then instructs the searched-for or identified machine to activate the editor program corresponding to the data EDITy. For example, if the data EDITy specifying the special editor is received by the server machine S1, then the machine S1 instructs one of the client machines $\mathbf{110}_n$ to activate the editor program corresponding to the data EDITy. After step Sb405 or Sb407, the CPU 200 of the server machine in question reverts to step Sb2 of FIG. 7 for detection of a further event.

As described, the server machine, having received the editor-specifying data EDITy from the client machine, shifts the operating mode to either the server edit more or the local edit mode depending on whether or not it is equipped with the editor specified by the received data EDITY. Then, the server machine will identify the operating mode shift as a managerial event and carries out operations corresponding to the new or shifted operating mode.

2-2-1-2. Server Edit Mode:

Therefore, the following paragraphs describe the behavior when the operating mode has shifted to the server edit mode. If the event identified at step Sb401 is a managerial event indicating a shift to the server edit mode, the CPU 200 of the server machine receives the data DATASET at step Sb408. Namely, the CPU 200 receives data indicative of a result of an editing input made using the editor specified by the data EDITy.

After that, the CPU 200 proceeds to step Sb409 in order to make a determination as to whether or not all of the data DATASET have been received. If answered in the negative, the CPU 200 reverts to step Sb2 of FIG. 7 in order to complete the data reception. With an affirmative answer at step Sb409, however, the CPU 200 proceeds to next step Sb410, where it creates tone parameter data PARSET based on the received data DATASET using the activated editor program corresponding to the data EDITy. Then, at step Sb411, the CPU 200 sends the thus-created tone parameter data PARSET back to the client machine from which the data EDITy were originally sent. After that, the CPU 200 reverts to step Sb2 of FIG. 7 for detection of a further editing input result or event.

Thus, in the server edit mode, the tone parameter data PARSET are created from the data DATASET indicative of the result of the editing input by the client machine and then sent back to the same client machine.

2-2-1-3. Local Edit Mode:

The behavior when the operating mode has shifted to the local edit mode is described in the following paragraphs. If the event identified at step Sb401 is a managerial event indicating a shift to the local edit mode, then the CPU 200 of the server machine goes to step Sb412 to conduct a data relay between the client machine and the other machine previously searched-for or identified at step Sb407.

The data to be relayed here from the client machine of the user to the other machine include the editor-specifying data EDITy and the data DATASET indicative of a result of the editing input via the editor, while the data to be relayed from the other machine to the client machine of the user include the editing screen data corresponding to the editor and the tone parameter data PARSET created by the other machine. After that, the CPU 200 reverts to step Sb2 of FIG. 7 for detection of a further editing input result or event.

Thus, in the local edit mode, the server machine only conducts the data relay between the client machine and the other machine. This is because the server machine is not equipped with (or can not activate) the editor specified by the data EDITy and hence is unable to create the tone parameter data PARSET from the data DATASET indicative of the result of the editing input.

3. Detailed Behavior

Next, detailed behavior of the instant embodiment will be described in relation to the case where the user actually edits a tone parameter on the on-line basis. Let's also assume that the power to the client and server machines on the communication network has already been turned on and the initialization process has already been carried out in these machines at steps Sa1 and Sb1.

First, the user instructs the client machine 1301 to activate the browser, using the mouse 209 and/or the keyboard 210. Then, the client machine 130, detects the user's activation instruction as an event, in response to which the browser processing is carried out at step Sa7 of FIG. 4 and the initial browser screen is displayed on the display 211 of the client machine at step Sa703 of FIG. 7.

Then, when the user selects, for example, the generic editor corresponding to a tone color to be edited and designates the server machine S1 as a party on the other end, the client machine identifies the user's editor selection as an event. Thus, at step Sa704 of FIG. 6, the client machine transmits, to the designated server machine S1, data EDITy specifying the selected generic editor along with a request for editing screen data corresponding to the editor specifying data EDITy. After that, the operating mode of the client machine is shifted to the reception mode at next step Sa705.

Figures 7, 9:
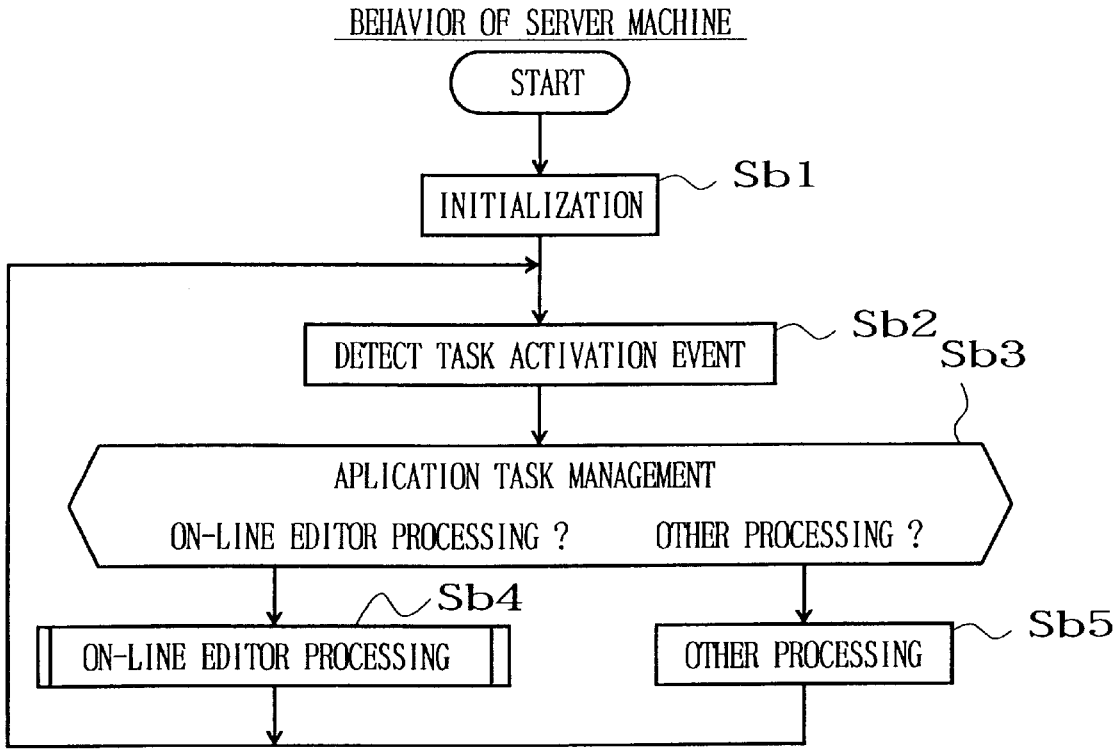
FIG. 7 is a flow chart illustrating exemplary behavior of the server machine in the embodiment.
FIG. 9 is a diagram showing an example of an editing screen displayed by the client machine in the embodiment.

Once the server machine S1 receives the editor specifying data EDITy from the client machine of the user and detects it as an event, the on-line editor processing is carried out at step Sb4 of FIG. 7 so that the operations at steps Sb403 to Sb405 of FIG. 8 are carried out. Namely, the operating mode of the server machine is set to the server edit mode, the editor program corresponding to the data EDITy is activated, and also the editing screen data corresponding to the data EDITy are sent back to the client machine.

Figure 6:
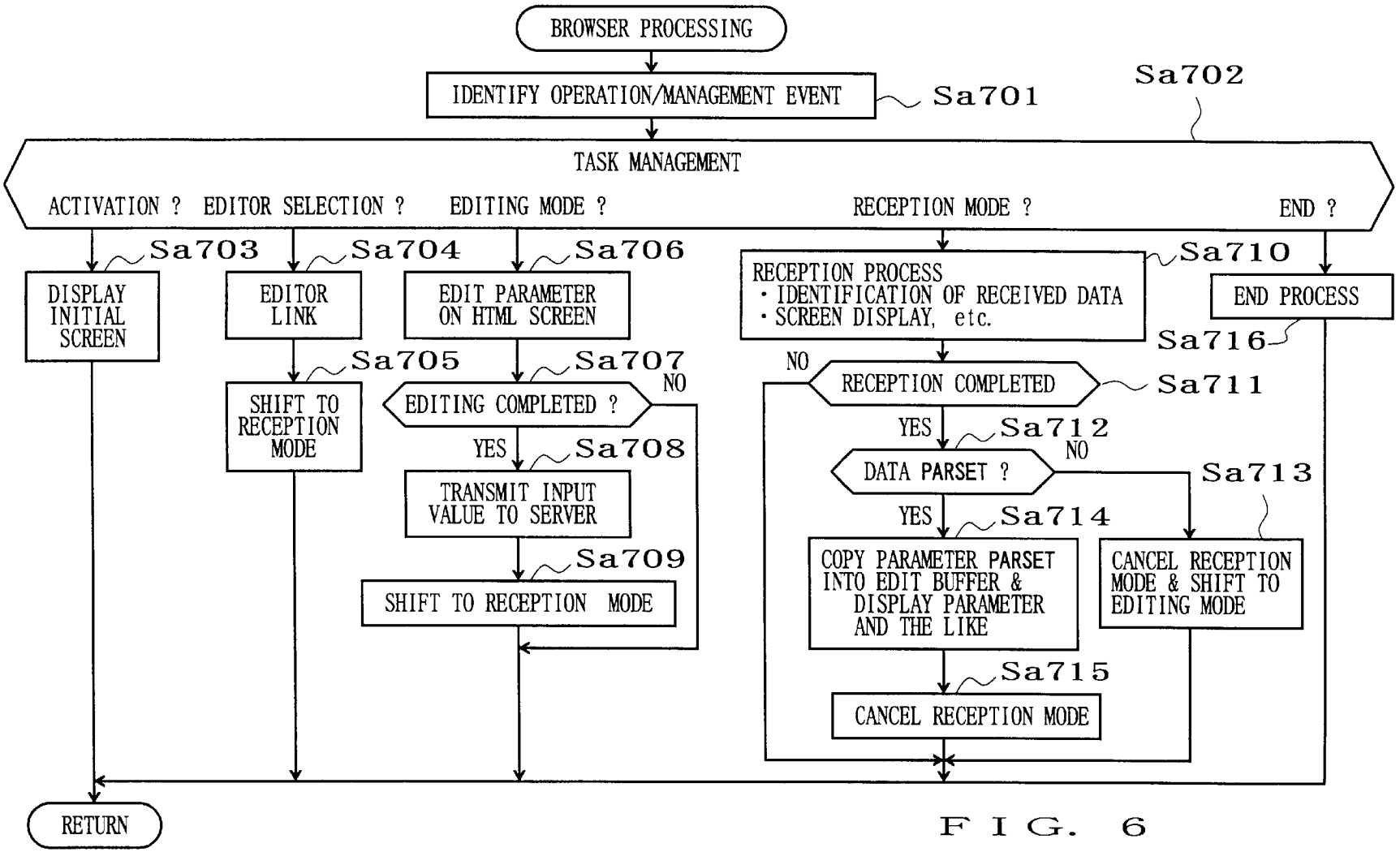
FIG. 6 is a flow chart illustrating browser processing carried out in the client machine.

Then, the client machine 1301, whose operating mode has already been shifted to the reception mode at step Sa705, receives the editing screen data from the server machine and identifies the data reception as an event, so that the operations at steps Sa710 to Sa713 of FIG. 6 are carried out in the client machine. As a result, a screen based on the editing screen data is visually shown on the display 211 of the client machine, and the reception mode is cancelled to shift the operating mode to the editing mode. This operating mode shift is detected as a managerial event, so that the user is allowed to give an editing input to the client machine at step Sa704. Thus, the user carries out such an editing operation as to indirectly define a tone parameter, such as by setting individual coordinates points defining a time-varying amplitude envelope shape (see FIG. 10). In response to the user's editing operation, the client machine sends the server machine S1 data DATASET indicative of the result of the user's editing input at step Sa708, and the operating mode is again shifted to the reception mode at following mode Sa709.

Thus, the server machine S1, whose operating mode has already been shifted to the server edit mode at step Sb404, receives the data DATASET from the client machine and identifies the data reception as an event, so that the operations at steps Sb408 to Sb411 of FIG. 8 are carried out. Once all of the data DATASET are duly received from the client machine, the server machine creates tone parameter data PARSET on the basis of the received data DATASET and transmits the created data PARSET to the client machine $\mathbf{130}_1$.

Then, the client machine $\mathbf{130}_1$, whose operating mode has been again shifted to the reception mode at step Sa709, receives the tone parameter data PARSET from the server machine and identifies the data reception as an event, so that the operations at steps Sa710 to Sa712 and Sa714 and Sa715 of FIG. 6 are carried out in the client machine. As a consequence, all the tone parameter data PARSET are stored into the edited data storage region of the edit buffer having stored therein the designated tone color data, and also the values, shape and the like are visually shown on the display 211 of the client machine. After that, the reception mode is cancelled. In the above-mentioned manner, the user can obtain the tone parameter data PARSET as a result of his or her editing input operation. It will be appreciated that the tone color defined by the tone parameter can be actually sounded or used in a music performance by carrying out the tone generator processing and the performance information processing both shown in FIG. 4.

Thereafter, the editing input operation can be repeated in response to a further editing input to the client machine, or a tone parameter for another tone color can be designated as a subject for editing.

The above description has been made in relation to the case where the user selects the generic editor. Even when the user selects the special, dedicated or high-precision editor, it is only sufficient fort the user to designate the server machine S1. In such a case, the operating mode of the server machine S1 is set to the local edit mode because the server machine S1 is not equipped with the selected special, dedicated or high-precision editor. However, if there exits on the network any client machine $\mathbf{110}_n$ equipped with the selected editor, it suffices that the client machine $\mathbf{110}_n$ carry out the same operations as described above to transmit the editing screen data corresponding to the selected editor and create and transmit the tone parameter data PARSET on the basis of the data DATASET and the server machine S1 conducts the necessary data relay. With such a data relay, it is no longer necessary for the user to be concerned about whether or not the selected editor can be executed by the designated server machine S1.

According to the above-described embodiment, once the user selects a particular editor corresponding to a tone color to be edited, the editing screen data corresponding to the selected editor are sent back from the server machine S1. Further, in response to a user's editing input operation, via the editing screen, concerning the tone parameter of the tone color, an edited tone parameter can be obtained. This arrangement can eliminate the need for the client machine $\mathbf{130}_1$ of the user to be equipped with the editor. Stated differently, it is only necessary for the user to install the browser of the present invention, instead of installing editors covering all tone colors that are likely to be designated as a subject for editing.

Normally, the server machine S1 and other machines subordinate thereto, such as the client machine $\mathbf{110}_1$, need not be managed by the user; instead, these machines may be managed by a maker of the machines or other "third party" by way of the communication network. Consequently, the user is allowed to edit tone parameters of a great many tone colors, without having to install a plurality of editing programs in his or her machine.

4. Form of Application

The tone parameter editing system of the present invention has been described above in relation to the case where a piano tone color is designated as a subject for editing and its amplitude envelope is subjected to editing. However, the present invention is not so limited and is of course applicable to editing of any other tone parameters, such as those for use in a physical model tone generator that uses an electric model to simulate air streams in a natural musical instrument, which would unavoidably require complex arithmetic operations. Therefore, the following paragraphs further describe the present invention in relation to the case where the present invention is applied to editing of a tone parameter for use in such a physical model tone generator.

Figure 11:
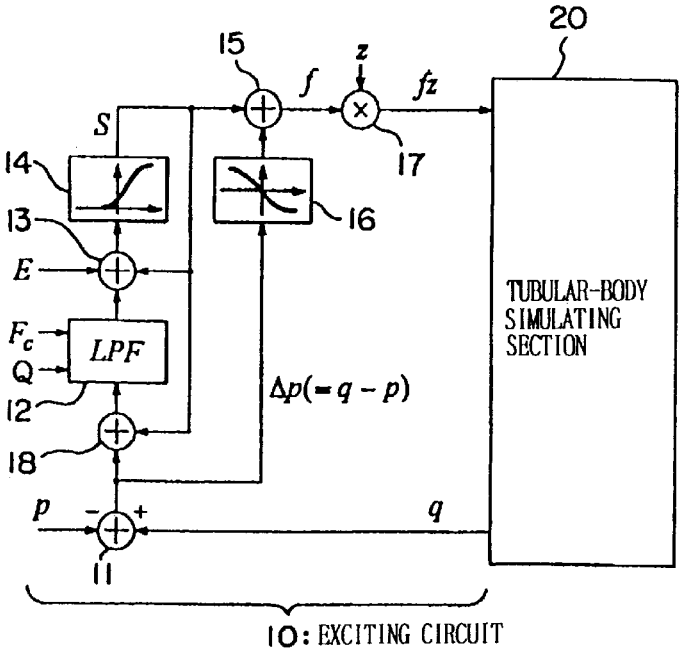
FIG. 11 is a block diagram showing an example of a physical model tone generator to which the present invention is applied.

4-1. Physical Model Tone Generator:

Before going into a description of the behavior of the inventive tone parameter editing system, an outline of the physical model tone generator is given below. FIG. 11 is a block diagram showing an exemplary setup of the physical model tone generator which is designed to synthesize a tone of a natural wind instrument. The illustrated physical model tone generator includes a tubular-body simulating section 20 for electrically approximating physical characteristics of the tubular body of the wind instrument, and an exciting circuit 10 for generating an excitation signal on the basis of performance operation by a human player and the like and feeding the excitation signal to the tubular-body simulating section 20. This physical model tone generator may be implemented either in software using the CPU 200 of the client machine manipulated by the user, or in hardware using the MIDI instrument 207. Various parameters for use in the exciting circuit 10 and tubular-body simulating section 20 are controlled on the basis of a user's editing input and performance operation.

In FIG. 11, a signal representing a pressure of air p blown into the mouthpiece (hereinafter called "mouth air pressure") is generated in accordance with an output of a sensor that detects player's performance operation and is fed to a minus (−) input terminal of a subtracter 11 in the exciting circuit 10. To a plus (+) input terminal of the subtracter 11 is fed a signal representing a pressure q within the mouthpiece and approximating an air reflection in the tubular body. Thus, the subtracter 11 outputs a signal corresponding to an air pressure difference Δp in a gap between the mouthpiece and the reed. Low-pass filter denoted at 12 in FIG. 11 serves to simulate movements of the reed by limiting the frequency band of the input signal. The reason why the low-pass filter 12 limits the frequency band is to simulate the followability of the reed responsive to a pressure variation on the reed. More specifically, the frequence band limitation is to simulate the characteristic that the reed would be displaced in response to a pressure variation with a certain time delay due to inertia in the reed and would become less responsive to the pressure variation as the frequency of the pressure variation increases.

The low-pass filter 12 is also supplied with parameters Fc and Q for controlling its characteristics in accordance with the player's performance operation; more specifically, the cut-off frequency and Q value of the low-pass filter 12 are set in accordance with these parameters Fc and Q. Output from the low-pass filter 12 is added via an adder 13 with an embouchure pressure signal E indicative of the pressure on the reed, to thereby provide a signal representing a pressure actually applied to the reed. The signal representing the pressure actually applied to the reed is then converted, via a nonlinear table 14, into a signal representing a sectional area S of the gap between the mouthpiece and the reed and is then given to one of two input terminals of a multiplier 15.

Further, the signal representing the air pressure difference Δp in the gap between the mouthpiece and the reed is also fed to another nonlinear table 16, which is intended to simulate a physical characteristic that in a narrow tubular passage, the air flow rate is saturated to become non-proportional to the air pressure variation despite a great increase in the air pressure difference. This simulation can generate a signal representing an air pressure modified in light of an effect which the air pressure on the reed gives the air flow rate.

Output signal from the nonlinear table 16 is applied to the other input terminal of the above-mentioned multiplier 15 for multiplication by the signal representing the sectional area S of the gap. The multiplied result is given to another multiplier 17 as a signal f representing a volumetric flow rate in the gap between the mouthpiece and the reed. The multiplier 17 multiplies the signal f by a signal representing an impedance z (correspondence to a resistance) of the mouthpiece, to provide a sound pressure signal fz corresponding to the air supplied through the mouth piece into the tubular body. The sound pressure signal fz is then passed, as an excitation signal, to the tubular-body simulating section 20. In this way, the exciting circuit 10 can electrically simulate an exciting section of the wind instrument including the reed.

4-2. Tubular-body Simulating Section:

Next, the tubular-body simulating section 20 is described in more detail. This tubular-body simulating section 20 feeds back the sound pressure signal fz as a signal q along a feedback path where a low-pass filter and a delay circuit are inserted. The low-pass filter in the feedback path serves to simulate the shape of the tubular body and, in particular, the shape of a resonating tube, and the delay circuit serves to simulate the length of the tubular body and a condition where an input wave from the mouthpiece is reflected back to the mouthpiece depending on the lengths of the resonating tube and tone holes. In this case, the delay time given by the delay circuit is controlled in accordance with a pitch of a tone to be generated. Because, strictly speaking, a time delay is produced by the low-pass filter of the feedback path as well, the pitch of the tone to be generated is controlled by controlling the delay time of the delay circuit taking into account the delay time of the low-pass filter in such a manner that a total delay time per wave circulation through the tubular-body simulating section 20 corresponds to the tone pitch.

In this form of application, several algorithms are normally provided in corresponding relation to the shape, type, etc. of the tubular body to be simulated; however, the following description will be made only in relation a representative one of these algorithms, just for convenience of description.

4-2-1. Representative Algorithm:

The representative algorithm is described below with reference to FIG. 12. This algorithm is designed to simulate the shape of the tubular body (a combination of cylindrical portions of different diameters) as shown in FIG. 15 in order to approximate a combination of open and closed conditions (including half-open condition) of the tone holes and register tubes, so as to be most similar to an acoustic musical instrument capable of realizing a tubular body of any desired shape.

Figure 12:
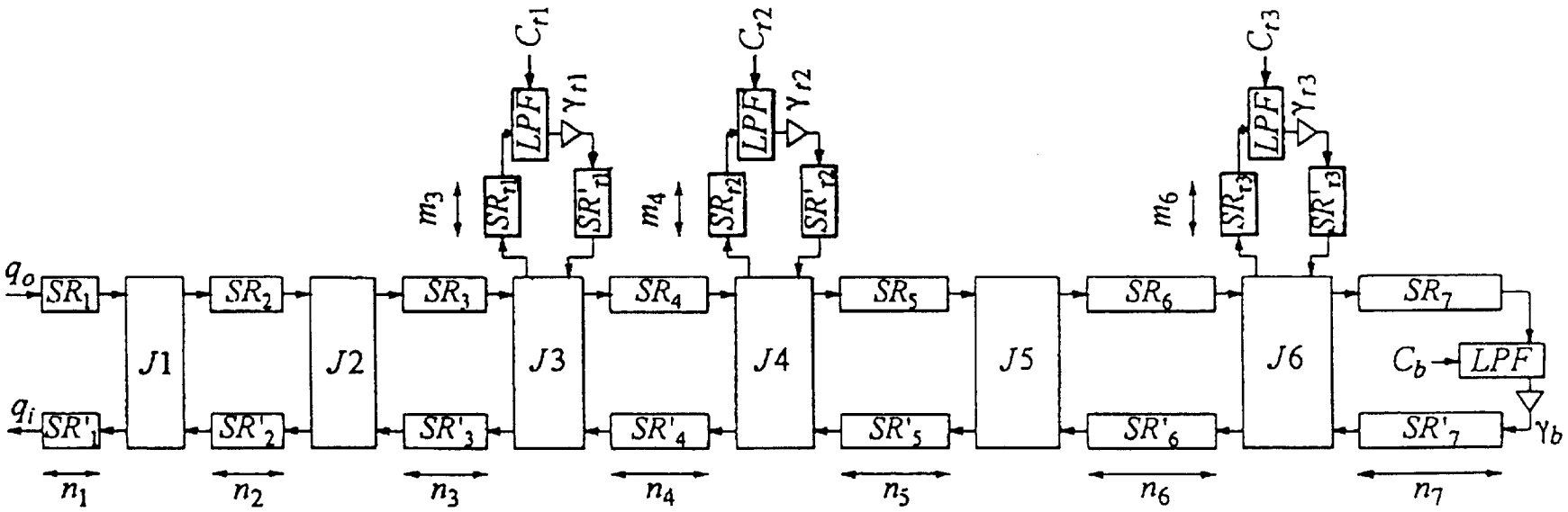
FIG. 12 is a block diagram showing an example of a tubular-body simulating section in the physical model tone generator of FIG. 11.

In FIG. 12, each reference character "SR" with a numerical subscript represents a shift register, which serves to simulate a transfer delay of the air pressure wave within the tubular body. Further, each reference character "J" with a numeral suffix represent a junction, which serves to simulate scattering of the air pressure wave that would occur at areas where the diameter of the tubular body varies. Furthermore, each reference character "LPF" represents a low-pass filter, which simulates an energy loss resulting from the reflection of the air pressure wave at various ends of the tubular body.

Figure 13A:
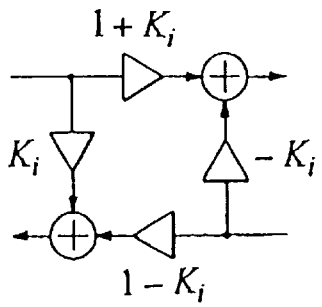
FIGS. 13A, 13B and 13C are block diagrams showing exemplary two-port junctions employed in the tubular-body simulating section of FIG. 12.
Figure 13B:
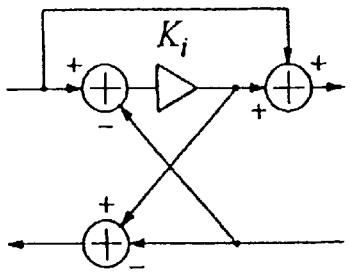
Figure 13C:
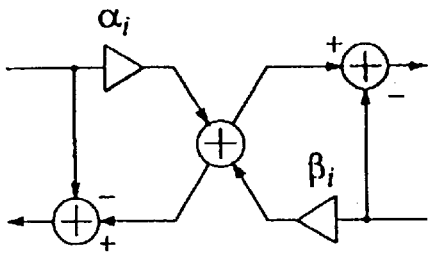
Figure 14:
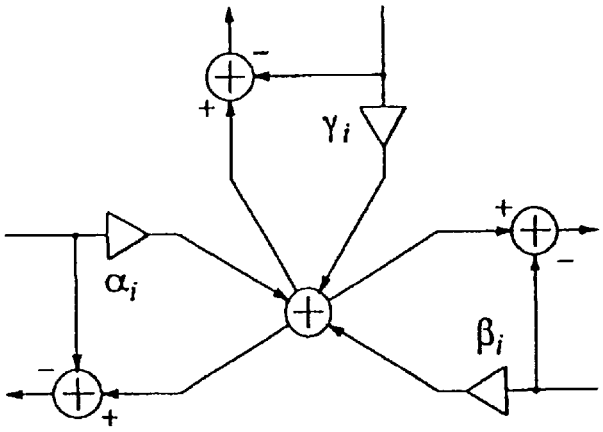
FIG. 14 is a block diagrams showing an example of a three-port junction employed in the tubular-body simulating section of FIG. 12.

Further, in FIG. 11, each of the junctions J1, J2 and J5 only has a step with no tone hole (i.e., a two-port junction), and its detailed construction is generally as shown in any one of FIGS. 13A to 13C. Each of the other junctions J3, J4 and J6 has a tone hole of a given height (i.e., "three-port junction"), and its detailed construction is generally as shown in FIG. 14.

Figure 15:
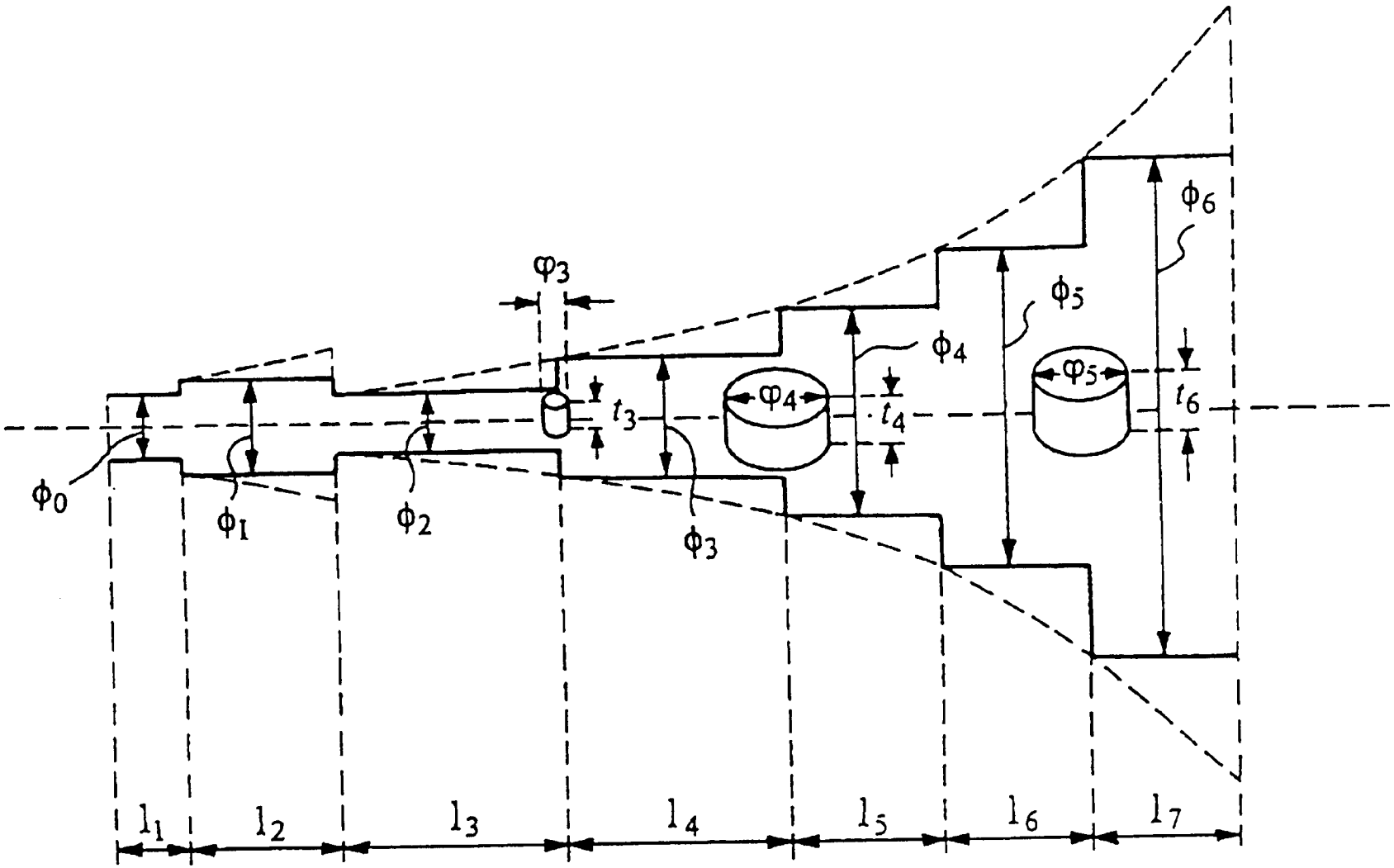
FIG. 15 is a diagram explanatory of an exemplary configuration of the tubular body to be simulated by the tubular-body simulating section of FIG. 12.

Here, parameters $\alpha$, $\beta$ and $\gamma$ depend on the diameters $\phi$ of the tubular body and tone holes shown in FIG. 15, and the numbers of stages m3, m4 and m5 of the shift registers $SR_{t3}$ and the like depend on the heights $\gamma_{t1}$ (t3, t4 and t6) of the tone holes. In addition, respective delay times of the individual shift registers SR correspond to the lengths 11 to 17 of the individual tubular portions of FIG. 15 and are controlled so as to correspond to a pitch of a tone to be synthesized. Furthermore, parameters $\gamma_{t1}$, $\gamma_{t2}$ and $\gamma_{t3}$ are all set such that they assume a negative value when the tone holes of FIG. 15 are open but assume a positive value when the tone holes are closed. Note that according to the algorithm, presence or absence of the tone holes in the individual junctions can also be set as desired. The foregoing is just the outline of the physical model tone generator, and more details of the algorithm are disclosed in Japanese Patent Laid-open Publication No. HEI-5-80761.

4-2. Tone Parameter Editing Input to Physical Model Tone Generator:

For tone colors to be generated by the physical model tone generator, the user is allowed to create colors not existing in reality, by feeding an editing input relating to the shape of the tubular body and the like. To this end, the user has to first select a special editor corresponding to the physical model tone generator, as by operating the client machine $\mathbf{130}_1$ of FIG. 1. In response to the user's editor selection, the client machine $\mathbf{130}_1$ in question transmits data EDITy indicative of the selected editor to the server machine S1. The server machine S1, which is equipped only with the generic editor, is set to the local edit mode to instruct another client machine $\mathbf{110}_n$, on the network, which is equipped with the special editor, to activate that special editor. In response to the instruction from the server machine S1, the other client machine $\mathbf{110}_n$ activates the special editor and sends corresponding editing screen data to the client machine $\mathbf{130}_1$ through a relay by the server machine S1.

In this case, it is desirable that the editing input screen actually show the shape of the tubular body to be simulated, as in the illustrated example of FIG. 15. On the editing input screen, the user enters the diameters $\phi$ and lengths of the individual tubular body portions, presence/absence, diameters $\phi$ and heights t of the tone holes, using the mouse 209 and/or the keyboard 210. Then, the client machine transmits, to the server machine S1, these input values as data DATASET, and the server machine S1, in turn, relays the data DATASET to the other client machine $\mathbf{110}_n$. Once the data DATASET are received, the other client machine 110n creates tone parameter data PARSET by means of the activated special editor and transmits the created data PARSET to the client machine $\mathbf{130}_1$ operated by the user. Here, the tone parameter data PARSET define various parameters such as the number of stages of the shift registers SR and coefficients for use in the junctions J. Thus, the $\mathbf{130}_1$ sets tone parameters on the basis of the tone parameter data PARSET transmitted by way of the server machine S1 and visually shows, on its display 211, the shape of the tubular body responsive to his or her editing input and based on tone parameter settings.

With the above-described arrangement, it is possible for the user to edit tone parameters for use in the physical model tone generator without having to install a special editor, such as the editor for the physical model tone generator, in the client machine operated by the user.

Whereas the preferred embodiment and form of application have been described above as creating the tone parameter defining data PARSET on the basis of the data indicative of the editing input result by means of the server machine equipped with the user-selected editor, sampling data of waveforms having a tone color and/or characteristics defined by the tone parameter of the data DATASET may be arithmetically generated by the server machine as the result of editing. Thus, even where the user does not own the MIDI instrument 207 or other tone generating devices having a function of forming waveforms based on tone parameters, the user is allowed to reproduce a tone on the basis of his or her editing input as long as the user's machine has a function of reproducing the sampling data of the waveforms generated and transmitted by the server machine; beside, the maker can expect that potential users become interested in purchasing the MIDI instrument sooner or later.

In another modification, contents of processing, quantity of transmitted/received data and type in and of a particular one of the machines on the communication network, which actually executes the editor program, may be varied depending on the specifications of the client machine operated by the user or user environment. For instance, contents and scale of the editor processing, a format of data to be transmitted/received, etc. may be instructed in the light of the user environment, by transmitting information representative of the user environment and equipment used along with the data EDITy specifying a user-selected editor in such a manner that the server machine or other client machine, actually carrying out the editor processing, is allowed to know the user environment. More specifically, in situations where the user's machine has a low graphic display capability (including a situation where the user intentionally made settings to eliminate a need for graphic data), only the tone parameter data PARSET generated as a result of editing may be transmitted from the editing machine to the user's machine, and creation, transmission, etc. of image data to be displayed in relation to the tone parameter data PARSET may be omitted, so as to carry out processing in a manner corresponding to the user environment. In this specific example, significant reduction in the loads on the individual machines and in the data traffic is achieved.

With the present invention arranged in the above-described manner, tone parameters for a great many tone colors can be edited appropriately without installing a plurality of editing devices or editing programs in a user's machine. In addition, the present invention can eliminate a need f or the user to always be concerned about which one of the computers on the communication network is actually equipped with a selected editor, by the user only specifying one particular computer on the communication network.

What is claimed is:

1. A method of editing a parameter defining a characteristic of a tone by use of at least two computers interconnected via a communication network, said method comprising:

a first step of accepting a parameter editing input by means of a first one of said computers;

a second step of transmitting data, corresponding to the parameter editing input accepted by said first computer, to a second one of said computers via the communication network;

a third step of using at least said second computer to carry out parameter editing processing responsive to the data transmitted by said second step and then sending a result of the parameter editing processing back to said first computer via the communication network; and a fourth step of receiving, by means of said first computer, the result of the parameter editing processing sent back by said third step.

2. A method as recited in claim 1 wherein said third step causes said second computer to execute the parameter editing processing responsive to the transmitted data.

3. A method as recited in claim 1 wherein said third step causes a third one of said computers to execute the parameter editing processing responsive to the transmitted data via the communication network through a relay by said second computer.

4. A method as recited in claim 1 wherein said third step includes a step of determining whether the parameter editing processing responsive to the transmitted data is executable by said second computer or not, and, when it is determined that the parameter editing processing is executable by said second computer, causing said second computer to execute the parameter editing processing.

5. A method as recited in claim 4 wherein said third step includes a step of, when it is determined that the parameter editing processing is not executable by said second computer, causes a third one of said computers to execute the parameter editing processing by use of said communication network.

6. A method as recited in claim 1 wherein said first step includes a step of selecting an editor to be used, said third step includes a step of transmitting editing screen information of the editor selected by said first step to said first computer via the communication network, and said fourth step receives the editing screen information transmitted by said third step, whereby an editing screen is shown on a display of said first computer in such a way that an editing input operation is permitted with reference to the editing screen on the display.

7. A method as recited in claim 6 wherein said first step further includes a step of inputting desired editing data using the editing screen on the display, and said third step further includes a step of executing editing processing based on the selected editor in accordance with the editing data inputted via said first step.

8. A method as recited in claim 6 wherein said first step includes a step of selecting an editor, from among a plurality of editors, which corresponds to a characteristic of a tone to be edited.

9. A method as recited in claim 1 wherein said second step includes a step of transmitting, to said second computer, information indicative of a user environment of said first computer, and said third step includes a step of, in accordance with said information indicative of a user environment of said first computer transmitted by said second step, varying a content of the parameter editing processing or the result of the parameter editing processing to be sent back to said first computer.

10. A method as recited in claim 1 wherein the result of the parameter editing processing to be sent back from said second computer to said first computer by said third step includes an edited parameter or tone waveform sample data corresponding to the edited parameter.

11. A method as recited in claim 1 which further comprises a fifth step of generating a tone by use of a parameter corresponding to the result of the parameter editing processing received by said fourth step.

12. A system for editing a parameter defining a characteristic of a tone by use of at least two computers interconnected via a communication network, a first one of said computers comprising:

first means for inputting parameter editing data;

second means for transmitting, via the communication network, the parameter editing data inputted via said first means; and third means for receiving information from the communication network, a second one of said computers comprising:

fourth means for receiving the parameter editing data transmitted from said first computer via the communication network;

fifth means for executing parameter editing processing responsive to the parameter editing data received by said fourth means; and sixth means for transmitting, via the communication network, a result of the parameter editing processing executed by said fifth means, wherein the result of the parameter editing processing transmitted from said second computer via the communication network is received by said first computer.

13. A system as recited in claim 12 wherein said second computer is equipped with a plurality of editing programs, said first means includes means for selecting an editing program to be used, and said fifth means activates the editing program selected by said first means to thereby execute the parameter editing processing responsive to the parameter editing data received by said fourth means in accordance with the selected editing program.

14. A system as recited in claim 12 wherein said first means includes means for selecting an editing program to be used from among a plurality of editing programs, and wherein when the editing program selected by said first means is executable by said second computer, said fifth means executes the parameter editing processing responsive to the parameter editing data received by said fourth means in accordance with the selected editing program, while when the editing program selected by said first means is not executable by said second computer, said fifth means conducts a data relay such that another computer connected to the communication network executes the parameter editing processing in accordance with the selected editing program.

15. A system as recited in claim 12 wherein said first computer further comprises means for generating a tone by use of a parameter corresponding to the result of the parameter editing processing received by said first computer.

16. A system for editing a parameter defining a characteristic of a tone by use of at least two devices interconnected via a communication network, a first one of said devices comprising:

an input section that inputs parameter editing data;

a first transmitter section that transmits, via the communication network, the parameter editing data inputted via said input section; and a first receiver section that receives information from the communication network, a second one of said devices comprising:

a second receiver section that receives the parameter editing data transmitted from said first device via the communication network;

a processing section that executes parameter editing processing responsive to the parameter editing data received by said second receiver section; and a second transmitter section that transmits, via the communication network, a result of the parameter editing processing executed by said processing section, wherein the result of the parameter editing processing transmitted from said second transmitter section via the communication network is received by said first receiver section of said first device.

17. A system as recited in claim 16 wherein said first device further comprises tone generation section that generates a tone by use of a parameter corresponding to the result of the parameter editing processing received by said first receiver section.

18. A method of editing a parameter defining a characteristic of a tone by use of at least two computers interconnected via a communication network, said method being executed by a first one of said computers, said method comprising:

a first step of accepting a parameter editing input;

a second step of transmitting data, corresponding to the parameter editing input accepted by said first step, to a second one of said computers via the communication network; and a third step of receiving data that is transmitted from said second computer via the communication network in response to the data corresponding to the parameter editing input transmitted by said second step, wherein parameter editing processing responsive to the data corresponding to the parameter editing input is executed by means of at least said second computer and a result of the parameter editing processing is sent back to said first computer via the communication network.

19. A method as recited in claim 18 wherein said first step includes a step of selecting an editor to be used, said second step includes a step of transmitting, to said second computer, data specifying the editor selected by said first step and thereby requests said second computer to send back editing screen information corresponding to the selected editor, said third step receives the editing screen information that is transmitted from said second computer via the communication network in response to the selected editor, and said first step further includes a step of showing an editing screen on a display of said first computer on the basis of the editing screen information received by said third step, whereby an editing input operation is permitted with reference to the editing screen on the display.

20. A method as recited in claim 19 wherein said first step further includes a step of inputting desired editing data using the editing screen shown on the display, and wherein said second computer executes editing processing responsive to the selected editor in accordance with the editing data inputted via said first step and a result of the editing processing executed by said second computer is sent from said second computer, via the communication network, back to said first computer and received by said third step.

21. A method as recited in claim 18 which further comprises a fourth step of generating a tone by use of a parameter corresponding to the result of the parameter editing processing received by said third step.

22. A system for editing a parameter defining a characteristic of a tone by use of at least two computers interconnected via a communication network, a first one of said computers comprising:

first means for accepting a parameter editing input;

second means for transmitting data, corresponding to the parameter editing input accepted by said first means, to a second one of said computers via the communication network; and third means for receiving data that is transmitted from said second computer via the communication network in response to the data corresponding to the parameter editing input transmitted by said second means, wherein parameter editing processing responsive to the data corresponding to the parameter editing input is executed by means of at least said second computer and a result of the parameter editing processing is sent back to said first computer via the communication network.

23. A system as recited in claim 22 wherein said first computer further comprises means for generating a tone by use of a parameter corresponding to the result of the parameter editing processing received by said first computer.

24. A system for editing a parameter defining a characteristic of a tone by use of at least two devices interconnected via a communication network, a first one of said devices comprising:

an input section that accepts a parameter editing input;

a transmitter section that transmits data, corresponding to the parameter editing input accepted by said input section, to a second one of said devices via the communication network; and a receiver section that receives data that is transmitted from said second device via the communication network in response to the data corresponding to the parameter editing input transmitted by said transmitter section, wherein parameter editing processing responsive to the data corresponding to the transmitter section input is executed by means of at least said second device and a result of the parameter editing processing is sent back to said first device via the communication network.

25. A system as recited in claim 24 wherein said first device further comprises tone generation section that generates a tone by use of a parameter corresponding to the result of the parameter editing processing received by said receiver section.

26. A method of editing a parameter defining a characteristic of a tone by use of at least two computers interconnected via a communication network, said method being executed, in response to a parameter editing input accepted by a first one of said computers, by a second one of said computers, said method comprising:

a first step of receiving, via the communication network, data generated by said first computer in response to the parameter editing input;

a second step of executing parameter editing processing responsive to the data received by said first step; and a third step of transmitting a result of the parameter editing processing executed by said second step to said first computer via the communication network.

27. A method of editing a parameter defining a characteristic of a tone by use of at least two computers interconnected via a communication network, said method being executed, in response to a parameter editing input accepted by a first one of said computers, by a second one of said computers, said method comprising:

a first step of receiving, via the communication network, data generated by said first computer in response to the parameter editing input;

a second step of executing parameter editing processing responsive to the data received by said first step; and a third step of transmitting a result of the parameter editing processing executed by said second step to said first computer via the communication network, wherein when the parameter editing processing responsive to the data received by said first step is executable by said second computer, said second step executes the parameter editing processing by means of said second computer, while when the parameter editing processing responsive to the data received by said first step is not executable by said second computer, said second step conducts a data relay such that another computer connected to the communication network executes the parameter editing processing.

28. A method of editing a parameter defining a characteristic of a tone by use of at least two computers interconnected via a communication network, said method being executed, in response to a parameter editing input accepted by a first one of said computers, by a second one of said computers, said method comprising:

a first step of receiving, via the communication network, data generated by said first computer in response to the parameter editing input;

a second step of executing parameter editing processing responsive to the data received by said first step; and a third step of transmitting a result of the parameter editing processing executed by said second step to said first computer via the communication network, wherein said second computer is equipped with a plurality of editing programs, said second step includes a step of, when the data received by said first step is one selecting an editing program to be used, activating the editing program selected by the received data and preparing editing screen information corresponding to the activated editing program and a step of executing parameter editing processing responsive to the received data in accordance with the activated editing program, and said third step includes a step of transmitting the editing screen information prepared by said second step to said first computer via the communication network, whereby said first computer is allowed to display an editing screen of the selected editing program on the basis of the prepared editing screen information in such a way that an editing input operation is permitted with reference to the editing screen displayed by said fist computer.

29. A system for editing a parameter defining a characteristic of a tone by use of at least two computers interconnected via a communication network, parameter editing processing being executed, in response to a parameter editing input accepted via a first one of said computers, by a second one of said computers, said second computer comprising:

first means for receiving, via the communication network, data generated by said first computer in response to the parameter editing input;

second means for executing parameter editing processing responsive to the data received by said first means; and third means for transmitting a result of the parameter editing processing by said second means to said first computer via the communication network.

30. A system for editing a parameter defining a characteristic of a tone by use of at least two devices interconnected via communication network, parameter editing processing being excuted, in response to a parameter editing input accepted via a first one of said devices, by a second one of said devices, second device comprising:

a receiver that receives, via the communication network, data generated by said first device in response to the parameter editing input;

a processor that executes parameter editing processing responsive to the data received by said receiver section; and a transmitter that transmits a result of the parameter editing processing by said processing section to said first device via the communication network.

31. A machine-readable recording medium for use in processing to edit a parameter defining a characteristic of a tone using at least two computers interconnected via a communication network, said machine-readable recording medium containing program instructions executable by a first one of said computers to perform:

a first step of accepting a parameter editing input;

a second step of transmitting data, corresponding to the parameter editing input accepted by said first step, to a second one of said computers via the communication network; and a third step of receiving data that is transmitted from said second computer via the communication network in response to the data corresponding to the input transmitted by said second step, wherein parameter editing processing responsive to the data corresponding to the parameter editing input is executed by means of at least said second computer and a result of the parameter editing processing is sent back to said first computer via the communication network.

32. A machine-readable recording medium as recited in claim 31 wherein said first step includes a step of selecting an editor to be used, said second step includes a step of transmitting, to said second computer, data specifying the editor selected by said first step and thereby requests said second computer to send back editing screen information corresponding to the selected editor, said third step receives the editing screen information that is transmitted from said second computer via the communication network in response to the selected editor, and said first step further includes a step of showing an editing screen on a display of said first computer on the basis of the editing screen information received by said third step, whereby an editing input operation is permitted with reference to the editing screen on the display of said first computer.

33. A machine-readable recording medium as recited in claim 31 which further contains program instructions executable by said first computer to perform a fourth step of generating a tone by use of a parameter corresponding to the result of the parameter editing processing received by said third step.

34. A machine-readable recording medium for use in processing to edit a parameter defining a characteristic of a tone using at least two computers interconnected via a communication network, said machine-readable recording medium containing program instructions executable by a first one of said computers to perform:

a first step of receiving, via the communication network, data generated by a second one of said computers in response to the parameter editing input;

a second step of executing parameter editing processing responsive to the data received by said first step; and a third step of transmitting a result of the parameter editing processing executed by said second step to said second computer via the communication network.

35. A machine-readable recording medium as recited in claim 34 wherein when the parameter editing processing responsive to the data received by said first step is executable by said first computer, said second step executes the parameter editing processing by means of said first computer, while when the parameter editing processing responsive to the data received by said first step is not executable by said first computer, said second step conducts a data relay such that another computer connected to the communication network executes the parameter editing processing.

* * * * *